US010886610B2

(12) United States Patent
Lee et al.

(10) Patent No.: US 10,886,610 B2
(45) Date of Patent: Jan. 5, 2021

(54) PORTABLE ANTENNA CONTROL DEVICE AND ANTENNA CONTROL SYSTEM

(71) Applicant: KMW INC., Hwaseong-si (KR)

(72) Inventors: Dong-Hun Lee, Hwaseong-si (KR); Ki-Hoon Woo, Hwaseong-si (KR); Sung-Hak Kim, Anyang-si (KR); Yong-Hyo Jeon, Anyang-si (KR)

(73) Assignee: KMW INC., Hwaseong-si (KR)

( * ) Notice: Subject to any disclaimer, the term of this patent is extended or adjusted under 35 U.S.C. 154(b) by 0 days.

(21) Appl. No.: 16/274,270

(22) Filed: Feb. 13, 2019

(65) Prior Publication Data

US 2019/0173169 A1 Jun. 6, 2019

Related U.S. Application Data

(63) Continuation of application No. 15/476,962, which is a continuation of application No. (Continued)

(51) Int. Cl.

| | |
|---|---|
| ***H01Q 3/08*** | (2006.01) |
| ***H01Q 1/22*** | (2006.01) |
| ***H01Q 3/32*** | (2006.01) |
| ***H01Q 21/24*** | (2006.01) |
| ***H01Q 1/08*** | (2006.01) |
| ***H01Q 1/12*** | (2006.01) |
| ***H01Q 3/04*** | (2006.01) |
| ***H01Q 3/18*** | (2006.01) |
| ***H01Q 3/20*** | (2006.01) |

(52) U.S. Cl.

CPC ..... *H01Q 3/08* (2013.01); *H01Q 1/084* (2013.01); *H01Q 1/1264* (2013.01); *H01Q 1/2216* (2013.01); *H01Q 3/04* (2013.01); *H01Q 3/18* (2013.01); *H01Q 3/20* (2013.01); *H01Q 3/32* (2013.01); *H01Q 21/24* (2013.01)

(58) Field of Classification Search

None

See application file for complete search history.

(56) References Cited

U.S. PATENT DOCUMENTS

| | | | |
|---|---|---|---|
| 9,860,772 | B2 | 1/2018 | Xu |
| 2001/0033247 | A1 | 10/2001 | Singer |

(Continued)

FOREIGN PATENT DOCUMENTS

| | | | |
|---|---|---|---|
| CN | 102104888 | A | 6/2011 |
| JP | 2001-111473 | A | 4/2001 |

(Continued)

OTHER PUBLICATIONS

Machine translation CN102104888 Eurospacenet (Year: 2011).*

(Continued)

*Primary Examiner* — Graham P Smith

(57) ABSTRACT

A portable antenna control device includes: a main controller for generating a control signal for adjusting a device provided in an antenna; a modem unit for converting the control signal generated by the main controller into an on-off keying (OOK) signal; a power management unit for supplying direct current power; and an OOK port for synthesizing and outputting the OOK signal converted by the modem unit and the direct current power supplied by the power management unit.

11 Claims, 18 Drawing Sheets

Related U.S. Application Data

PCT/KR2014/009269, filed on Oct. 1, 2014, now Pat. No. 10,243,266.

(56) References Cited

U.S. PATENT DOCUMENTS

| | | | | |
|---|---|---|---|---|
| 2010/0164803 | A1* | 7/2010 | Ahlberg | H01Q 1/246 342/372 |
| 2012/0062356 | A1* | 3/2012 | Mann | H01Q 21/08 340/3.5 |
| 2012/0238211 | A1 | 9/2012 | Ferris | |
| 2014/0287696 | A1 | 9/2014 | Moon et al. | |

FOREIGN PATENT DOCUMENTS

| | | | |
|---|---|---|---|
| KR | 10-2005-0043238 | A | 5/2005 |
| KR | 10-2010-0122092 | A | 11/2010 |
| KR | 10-2013-0070144 | A | 6/2013 |
| KR | 10-2013-0087362 | A | 8/2013 |
| KR | 10-1392323 | B1 | 5/2014 |
| WO | 2008033076 | A1 | 3/2008 |

OTHER PUBLICATIONS

Yang, Da-quan, Application and Design of Base Station Built-in Multi-port AISG Control Unit, China Academic Juornal Electronic Publishing House, Telecommunications Journal, Sep. 2012 (Year: 2012).*

Lee et al., Design and Implementation of AISG MOdem for Antenna Line Device, 2011 First ACIS/ JNU International Conference on Computers, Networks, Systems, and Industrial Engineering. IEEE pp. 314-319 (Year: 2011).*

Written Opinion of the International Searching Authority for PCT/KR2014/009269, dated Jun. 26, 2015, and English Translation thereof.

International Search Report for PCT/KR2014/009269, dated Jun. 26, 2015, and English Translation thereof.

Non-final office action dated Jun. 26, 2018 for U.S. Appl. No. 15/476,962.

Notice of Allowance dated Nov. 20, 2018 for U.S. Appl. No. 15/476,962.

* cited by examiner

PORTABLE ANTENNA CONTROL DEVICE AND ANTENNA CONTROL SYSTEM

CROSS REFERENCE TO RELATED APPLICATIONS

The present application is a continuation of U.S. application Ser. No. 15/476,962, filed on Mar. 31, 2017, which is a continuation of International Application No. PCT/KR2014/009269 filed on Oct. 1, 2014, the entire disclosures of which are incorporated herein by reference in their entirety.

TECHNICAL FIELD

The present disclosure relates to an antenna of a mobile communication base station, and more particularly, to a portable antenna control device capable of remotely controlling an operation of a corresponding antenna based on 3rd Generation Partnership Project (3GPP) or Antenna Interface Standards Group (AISG) protocol and an antenna control system.

An antenna system of a mobile communication base station currently in widespread use generally has a structure in which a plurality of radiation elements capable of performing transmission and reception using two polarizations (usually X polarization) perpendicular to each other are vertically arranged. The X polarization is such that a polarization plane is basically aligned at an angle of +45° or −45° with respect to a horizontal or vertical plane.

The antenna system typically includes devices for remotely controlling the state of the radiation beam of the antenna, for example, a remote electrical tilt (RET) device for adjusting an electronic down tilt angle, a remote azimuth steering (RAS) device for remotely adjusting azimuth steering, a remote azimuth beamwidth (RAB) device for remotely adjusting a beam width of the azimuth, or the like. An example of the antenna including the devices is disclosed in Korean Patent Laid-Open Publication No. 10-2010-0122092 (Title: "Multi-beam antenna with a multi-device control unit," inventors: Girard Gregory, Sulie Frank, Published Date: Nov. 19, 2010) first filed by Amphenol Corporation.

In the above, for example, the down tilt angle adjustment is used to reduce co-channel interference or to cover non-service areas right close to the base station. Further, the down tilt angle adjustment is used to reduce overlap between the respective base station sectors due to traffic congestion in downtown areas where there are a large number of base stations and to reduce interference between neighboring base stations due to an antenna side-lobe.

Antenna Interface Standards Group (AISG) v2.1.0 has recently been proposed for the control of RET, RAS, and RAB devices as described above, and a communication scheme based on the 3rd Generation Partnership Project (3GPP) protocol has also been proposed.

FIG. 1 is a block diagram of a system for an RET control of an antenna using a portable antenna control device in a general mobile communication base station. According to the 3GPP or AISG standards, for example, the RET control is largely divided into a primary station and a secondary station. Referring to FIG. 1, the mobile communication base station may generally be configured to include an antenna system installed at an elevated location such as a top of a building or a pillar, a base station body system installed on the ground, and a feeder cable connecting between the antenna system and the base station body system, in which the primary station portion may correspond to the base station body system and the secondary station portion may correspond to the antenna system.

In more detail, the primary station portion, which is a master portion, refers to a portion to transmit a control signal, such as a master control unit (MCU) 22 that may be installed in the base station body system and the secondary station portion, which is a slave portion, refers to a portion to receive a control signal and perform an operation according to the corresponding control signal, such as an RET 14 and an antenna line device (ALD) modem (top ALD modem) 13.

The base station body unit 21 performs basic transmission and reception RF signal processing operations and transmits RF signals through the feeder cable. The MCU 22 transmits a DC signal corresponding to an operation power source for driving the RET equipment 14 and an RS-485 communication signal for control. In the signals transmitted from the above two portions, a bottom ALD modem 23 provided in the base station body system converts an RS-485 signal into an on-off keying (OOK) signal and then combines the on-off keying signal with a direction current (DC) signal+an RF signal. The signal combined in the bottom ALD modem 23 is again transmitted to the bottom of the antenna through the feeder cable. In the signal transmitted through the feeder cable as described above, the top ALD modem 13 provided in the antenna system converts the OOK signal into the RS-485 signal and then transmits the RS-485 to the RET equipment 14 along with the direct current (DC) signal to support a function of the RET equipment 14 to receive commands.

At this time, the top ALD modem 13 and the RET equipment 14 are connected to each other via the AISG cable to transmit a signal and the top ALD modem 13 and the antenna 10 are connected to each other via the feeder cable to transmit an RF signal. Further, the top ALD modem 13 provides the RF signal separated from the DC signal+the OOK signal to the first antenna unit 11 which includes a plurality of transmitting and receiving radiating devices. Meanwhile, the antenna 10 may include a plurality of antenna units each including a plurality of transmitting and receiving radiating devices, for example, a first antenna unit 11, a second antenna unit 12, or the like. Also, a control signal for controlling the RET equipment 14 may be provided through a feeder cable of one of the antenna units, for example, the first antenna unit 11.

Meanwhile, the RET equipment 14 has been described above, as an example, as an equipment which is mounted on the antenna 10 to receive the control signal transmitted from the base station body system and perform an operation according to the corresponding control signal, but both the RAS equipment and the RAB equipment may also be operated while being mounted in the same or similar manner. Further, the portable antenna control device may have the structure in which, when all the RET equipment, the RAS equipment, and the RAB equipment are mounted, they may be connected to one another in a daisy chain manner using the AISG cable. At this point, the DC+RS-485 signals provided from the external top ALD modem 13 may be connected to the RET equipment to be primarily provided to the RET equipment. In the above configuration, the RET equipment 14, and the like are mounted inside a radome forming an appearance of the antenna 10 and is installed to be connected externally via the AISG connector. Further, the top ALD modem 13 may be additionally installed at a bottom of the outside of the radome of the antenna 10 as a separate equipment, connected to the RET equipment 14 via an AISG cable, and connected to a connector formed at a lower cap of the radome of the antenna 10, for example, a Deutsch Industrial Norms (DIN) connector via the feeder cable that is separate from the antenna 10.

Meanwhile, a portable antenna control device (PAC) 31 may be used to check the operation of the antenna system during installation or maintenance of the antenna system. However, the existing PAC 31 supports only RS-485 communication for ALD control conforming to the AISG standard of ALD. Therefore, the ALD control is not made only by the RS-485 communication under various field environments, and therefore there arise inconvenience situations that additional devices (e.g., modem 32) need to be additionally used.

Therefore, there is a need for a function capable of using the PAC 31 to control the ALD not only by the RS-485 signal but also by various signals (e.g., OOK signal) if necessary.

SUMMARY OF INVENTION

An object of the present disclosure is to provide a portable antenna control device capable of controlling an antenna system with an OOK signal by including a modem capable of converting an OOK signal and an OOK communication interface and an antenna control system.

Another object of the present disclosure is to provide a portable antenna control device connected to a PC by including an RS-232 communication interface to be able to easily install and update software, and an antenna control system.

In one general aspect, a portable antenna control device includes: a main controller for generating a control signal for adjusting a device provided in an antenna; a modem unit for converting the control signal generated by the main controller into an on-off keying (OOK) signal; a power management unit for supplying direct current power; and an OOK port for synthesizing and outputting the OOK signal converted by the modem unit and the direct current power supplied by the power management unit.

The device provided in the antenna may be at least one of a remote electrical tilt (RET) equipment for adjusting an electronic down tilt angle, a remote azimuth steering (RAS) equipment for adjusting azimuth steering, and a remote azimuth beamwidth (RAB) equipment for adjusting an azimuth beamwidth.

The control signal generated by the main controller may be a transistor-transistor logic (TTL) signal.

The portable antenna control device may further include: an RS-485 converter for converting the control signal generated by the main controller into an RS-485 signal; and an RS-485 port for synthesizing and outputting the RS-485 signal converted by the RS-485 converter and DC power provided from the power management unit.

The portable antenna control device may further include: an RS-232 converter for converting the control signal generated by the main controller into an RS-232 signal; and an RS-232 port for synthesizing and outputting the RS-232 signal converted by the RS-232 converter and DC power provided from the power management unit.

The portable antenna control device may further include: a low pass filter (LPF) provided between the modem unit and the OOK port and filtering and passing a band of an OOK signal converted by the modem unit.

The portable antenna control device may further include: a charging battery for charging and storing power input from an outside; and a battery charge controller for charging the charging battery with a DC voltage supplied from an external AC/DC adapter.

In another general aspect, an antenna control system includes: a portable antenna control device for generating a control signal for adjusting a device provided in an antenna and converting the generated control signal into an on-off keying (OOK) signal and synthesizing the converted OOK signal and DC power and outputting the synthesized OOK signal and DC power through an OOK port; a top ALD modem for converting the OOK signal into an RS-485 signal, in a signal transmitted via a feeder cable connected to the OOK port of the portable antenna control device; and an antenna including a radome that has an antenna unit and at least one remote control target equipment provided therein and receiving the RS-485 signal converted by the top ALD modem to control the at least one remote control target equipment.

The remote control target equipment provided in the antenna may be at least one of a remote electrical tilt (RET) equipment for adjusting an electronic down tilt angle, a remote azimuth steering (RAS) equipment for adjusting azimuth steering, and a remote azimuth beamwidth (RAB) equipment for adjusting an azimuth beamwidth.

The control signal may be a transistor-transistor logic (TTL) signal.

In another general aspect, an antenna control system includes: a portable antenna control device for generating a control signal for adjusting a device provided in an antenna and converting the generated control signal into an on-off keying (OOK) signal and synthesizing the converted OOK signal and DC power and outputting the synthesized OOK signal and DC power through an OOK port; an OOK bias T for combining and outputting the OOK signal output from the portable antenna control device and a radio signal output from a base station body unit; a conversion bias T (CBT) for converting the OOK signal among the signals output from the OOK bias T into an RS-485 signal; and an antenna including a radome that has an antenna unit and at least one remote control target equipment provided therein and receiving the RS-485 signal converted by the CBT to control the at least one remote control target equipment.

The remote control target equipment provided in the antenna may be at least one of a remote electrical tilt (RET) equipment for adjusting an electronic down tilt angle, a remote azimuth steering (RAS) equipment for adjusting azimuth steering, and a remote azimuth beamwidth (RAB) equipment for adjusting an azimuth beamwidth.

The control signal may be a transistor-transistor logic (TTL) signal.

In another general aspect, an antenna control system includes: a portable antenna control device for generating a control signal for adjusting a device provided in an antenna and converting the generated control signal into an on-off keying (OOK) signal and synthesizing the converted OOK signal and DC power and outputting the synthesized OOK signal and DC power through an OOK port; an OOK bias T for combining and outputting the OOK signal output from the portable antenna control device and a radio signal output from a base station body unit; a tower mounted amplifier (TMA) for converting the OOK signal among the signals output from the OOK bias T into an RS-485 signal; and an antenna including a radome that has an antenna unit and at least one remote control target equipment provided therein and receiving the RS-485 signal converted by the TMA to control the at least one remote control target equipment.

The remote control target equipment provided in the antenna may be at least one of a remote electrical tilt (RET) equipment for adjusting an electronic down tilt angle, a remote azimuth steering (RAS) equipment for adjusting azimuth steering, and a remote azimuth beamwidth (RAB) equipment for adjusting an azimuth beamwidth.

The control signal may be a transistor-transistor logic (TTL) signal.

In another general aspect, an antenna control system includes: a portable antenna control device for generating a control signal for adjusting a device provided in an antenna and converting the generated control signal into an on-off keying (OOK) signal and synthesizing the converted OOK signal and DC power and outputting the synthesized OOK signal and DC power through an OOK port; an OOK bias T for combining and outputting the OOK signal output from the portable antenna control device and a radio signal output from a base station body unit; and an antenna including a radome that has an antenna unit and at least one remote control target equipment provided therein and controlling the at least one remote control target equipment by an RS-485 signal among the signals received by the OOK bias T.

The antenna may include a signal separator for separating the OOK signal from a signal directly received from the portable antenna control device; and a modem unit converting the OOK signal separated by the signal separator to the control signal processed by a controller.

The remote control target equipment provided in the antenna may be at least one of a remote electrical tilt (RET) equipment for adjusting an electronic down tilt angle, a remote azimuth steering (RAS) equipment for adjusting azimuth steering, and a remote azimuth beamwidth (RAB) equipment for adjusting an azimuth beamwidth.

The control signal may be a transistor-transistor logic (TTL) signal.

As described above, the portable antenna control device according to the present disclosure may control the antenna line devices (ALDs) according to the AISG signal under various field device conditions. In addition, according to the embodiment of the present disclosure, the RS-485 signal and the OOK signal may be processed.

Further, the portable antenna control device according to the present disclosure may be conveniently carried and easily stored, compared with the type (MCU) that the portable antenna control device is fixed to the rack.

Further, the portable antenna control device may have the battery built therein or charge the battery, and therefore may control the ALD without the separate power supply and the PC.

In addition, the portable antenna control device may include the RS-232 port capable of interlocking with the PC to facilitate the antenna setting file download, the software upgrade, the software debugging, or the like.

In addition, it is possible to set the antenna without using the base station equipment when the antenna system is installed or initialized. In addition, it is possible to diagnose whether there is a problem in the ANT or there is a problem in the BTS when the problem occurs during the installation and operation of the antenna system.

DETAILED DESCRIPTION

Figure 1:
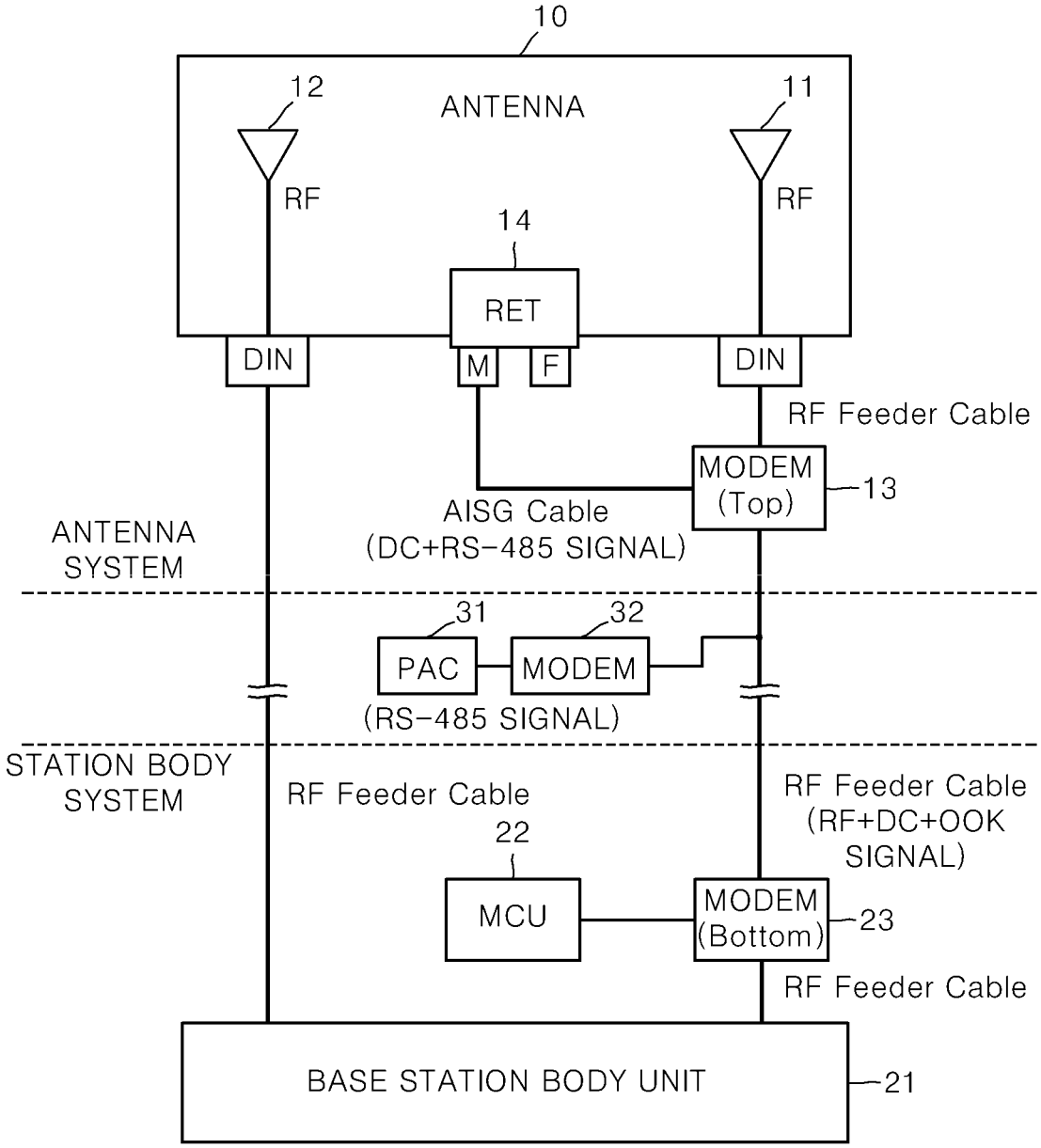
FIG. 1 is a block diagram of a system for an RET control of an antenna using a portable antenna control device in a general mobile communication base station.

Specific embodiments of the present disclosure will be described in detail with reference to the accompanying drawings. These embodiments will be described in detail for those skilled in the art in order to practice the present disclosure. It should be appreciated that various exemplary embodiments of the present disclosure are different from each other, but do not have to be exclusive. For example, specific shapes, configurations, and characteristics described in an embodiment of the present disclosure may be implemented in another embodiment without departing from the spirit and the scope of the present disclosure. In addition, it should be understood that a position or an arrangement of individual components in each disclosed exemplary embodiment may be changed without departing from the spirit and the scope of the present disclosure. Therefore, a detailed description described below should not be construed as being restrictive. In addition, the scope of the present disclosure is defined only by the accompanying claims and their equivalents if appropriate. Similar reference numerals will be used to describe the same or similar functions throughout the accompanying drawings.

Terms including an ordinal number such as 'first', 'second', etc., can be used to describe various components, but the components are not to be construed as being limited to the terms. The terms are only used to differentiate one component from other components. For example, the 'first' component may be named the 'second' component and the 'second' component may also be similarly named the 'first' component, without departing from the scope of the present disclosure. The term 'and/or' includes a combination of a plurality of items or any one of a plurality of terms.

Meanwhile, terms used herein are for the purpose of describing specific embodiments only, but are not intended for limiting the present disclosure. Singular forms used herein are intended to include plural forms unless context explicitly indicates otherwise. Further, it will be further understood that the terms "comprises" or "have" used in the present disclosure, specify the presence of stated features, steps, operations, components, parts mentioned in the present disclosure, or a combination thereof, but do not preclude the presence or addition of one or more other features, numerals, steps, operations, components, parts, or a combination thereof.

Unless indicated otherwise, it is to be understood that all the terms used in the specification including technical and scientific terms has the same meaning as those that are understood by those who skilled in the art. It must be understood that the terms defined by the dictionary are identical with the meanings within the context of the related art, and they should not be ideally or excessively formally defined unless the context clearly dictates otherwise.

Embodiments of the present disclosure disclose a portable antenna control device capable of remotely controlling an antenna system of a mobile communication base station.

The portable antenna control device according to an embodiment of the present disclosure controls operations of the corresponding antennas (for example, operations of RET, RAS, RAB, or the like) in accordance with 3rd Generation Partnership Project (3GPP) or Antenna Interface Standards Group (AISG) protocol.

At this time, the portable antenna control device according to the embodiment of the present disclosure may control the antenna system through a RF feeder cable by including an OOK communication interface as well as the existing RS-485 communication interface. In addition, according to the embodiment of the present disclosure, the portable antenna control device may further include an RS-232 communication interface to be connected to the PC, thereby facilitating installation and update of software.

Meanwhile, in the embodiments of the present disclosure to be described below, the potable antenna control device (PAC) is a highest concept collectively referred to as a portable antenna control device capable of controlling each function of an antenna by being connected to an antenna system, but this term does not limit a specific device.

A tower mounted amplifier (TMA) is a device including a low noise amplifier (LNA) and may control and electrically monitor it and may further include a modem function.

A remote electrical tilt (RET) is a device that may be adjusted by controlling the beam slope of an antenna with an electrical signal (for example, AISG signal) as described above.

An AISG cable refers to a cable assembly that is connected to a BTS to supply power betweens antennas and provide communication between the antennas based on AISG regulations.

A daisy chain is a kind of connection mode that connects among several devices in sequence and connects the respective devices in parallel to provide electrical communication.

A base transceiver station (BTS) is equipment capable of providing wireless communication between another BTS or cell site user equipment and a network.

A RS-485 signal is used as an AISG signal in the embodiments of the present disclosure and is a type of modulation scheme for displaying digital data according to the presence or absence of a carrier wave.

An on-off Keying (OOK) signal is used as an AISG signal in embodiments of the present disclosure and corresponds to a physical layer of an OSI model for a 2-wire half-duplex multipoint serial connection.

As a conversion bias T (CBT), there are two types, i.e., a BS modem and an antenna modem, and the CBT means a device or a modem that converts the RS-485 signal into the OOK signal, or the OOK signal into the RS-485 signal.

The RF feeder cable is a kind of coaxial cable for transmitting and receiving an antenna signal.

An OOK bias T is a device capable of transmitting an RF signal and an AISG signal by combining the RF signal with the AISG signal or separating the RF signal from the AISG signal and an RG-316 cable is one of standard coaxial cables.

An antenna line device (ALD) refers to a physical devices that may have an address, such as RET and TMA.

Hereinafter, in order for a person having ordinary skill in the art to which the present disclosure pertains to easily practice the present disclosure, the exemplary embodiments of the present disclosure will be described in detail with reference to the accompanying drawings.

Figure 2:
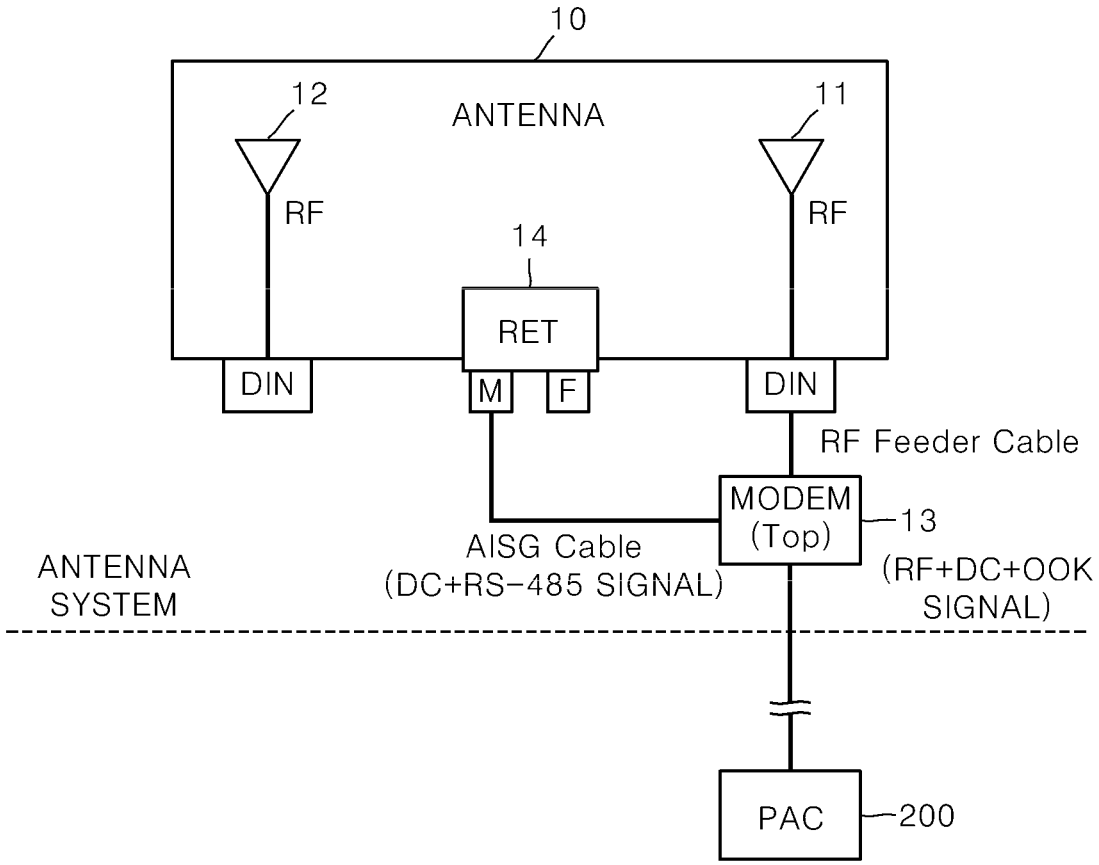
FIG. 2 is a block diagram of a system for an RET control of an antenna using a portable antenna control device in a mobile communication base station according to an embodiment of the present disclosure.

FIG. 2 is a block diagram of a system for an RET control of an antenna using a portable antenna control device (PAC) in a mobile communication base station according to an embodiment of the present disclosure. Referring to FIG. 2, a portable antenna control device (PAC) 200 according to an embodiment of the present disclosure is connected to a top ALD modem 13 of an antenna system via an RF feeder cable, thereby transmitting/receiving an OOK signal to/from an antenna system.

That is, a PAC 200 according to the embodiment of the present disclosure has a separate OOK port capable of transmitting and receiving an OOK signal, and separately includes a modem (for example, an AISG modem) capable of converting and processing the OOK signal, thereby controlling the antenna system using an OOK signal.

Accordingly, the OOK signal transmitted from the PAC 200 is converted into an RS-485 signal through the top ALD modem 13 of the antenna system, and the converted RS-485 signal is transmitted to the RET 14.

More specifically, the antenna system and the PAC 200 may be connected to each other via the RF feeder cable, and the RF feeder cable may simultaneously transmit an RF signal, a DC signal, and an OOK signal, as described above.

Therefore, RF+DC+OOK signals transmitted to the top ALD modem 13 of the antenna system are separated into the RF signal and the DC+OOK signals in the top ALD modem 13, and the OOK signal is converted into the RS-485 signal. At this time, the RF signal is transmitted to a first antenna unit 11 of an antenna 10 through the RF feeder cable, and the DC+RS-485 signals are transmitted to the RET 14 through the AISG cable. At this point, the RET 14 is controlled by the RS-485 signal transmitted to the RET 14, such that the antenna system (e.g., RET 14) may be controlled by the OOK signal in the PAC 200.

Hereinafter, the detailed structure of the PAC 200 according to the embodiment of the present disclosure will be described with reference to FIGS. 3 and 4.

Figure 3:
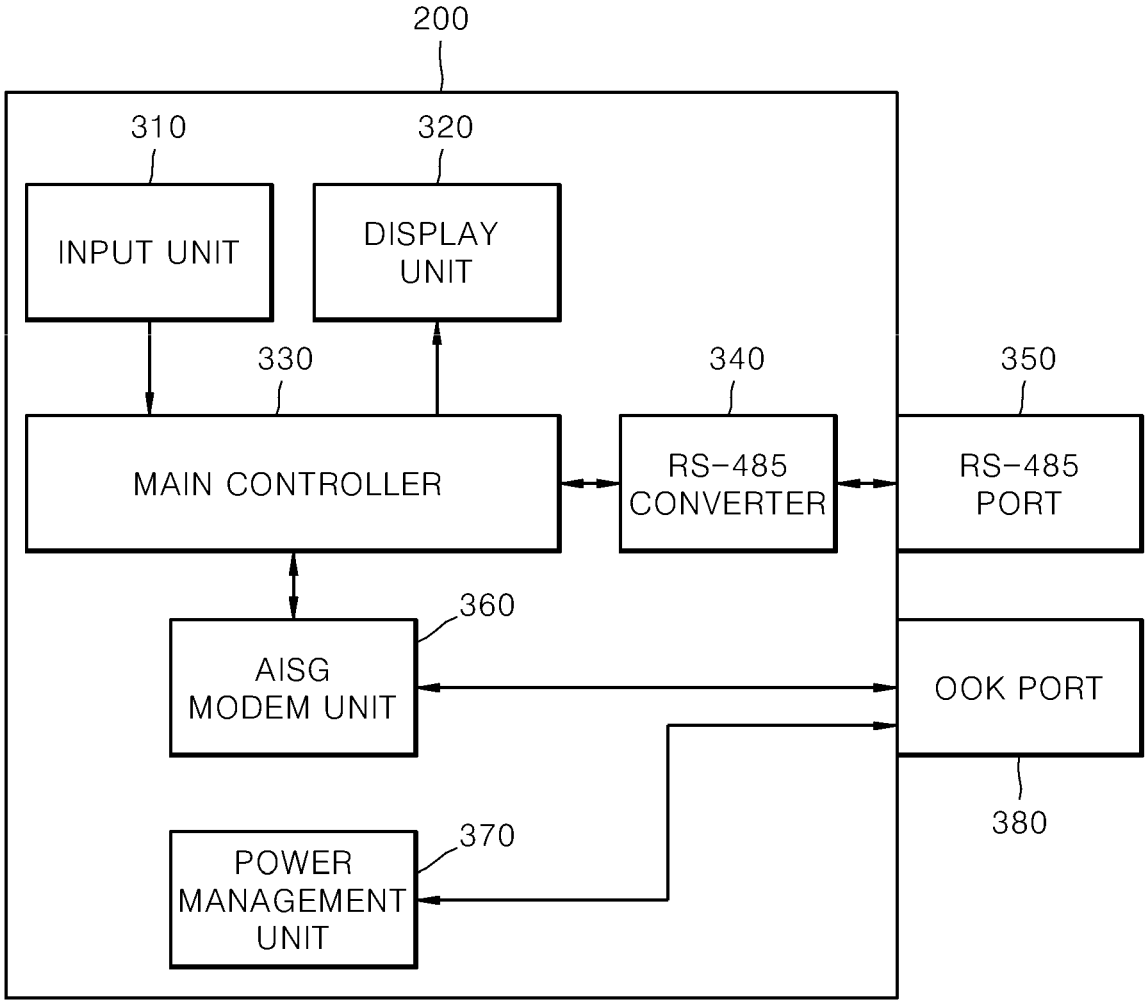
FIG. 3 is a block diagram illustrating a detailed configuration of the portable antenna control device according to the embodiment of the present disclosure.

FIG. 3 is a block diagram illustrating a detailed configuration of the portable antenna control device according to the embodiment of the present disclosure. Referring to FIG. 3, the PAC 200 according to the embodiment of the present disclosure may be configured to include an input unit 310, a display unit 320, a main controller 330, an RS-485 converter 340, an RS-485 port 350, an AISG modem unit 360, a power management unit 370, and an OOK port 380.

The input unit 310 is a means for inputting information like a keypad and the display unit 320 is a means for outputting information like an LCD. The main controller 330 functions as a central processing unit to control each components of the PAC 200.

The RS-485 converter 340 serves to convert the RS-485 signal received through the RS-485 port 350 into a signal that may be processed by the main controller 330, for example, the Antenna Interface Standards Group (AISG) signal into a transistor-transistor logic (TTL) signal. Further, the RS-485 converter 340 converts an antenna system control signal (e.g., TTL signal) received from the main controller 330 into the RS-485 signal. The RS-485 port 350 is an output port of the RS-485 signal. Accordingly, the RS-485 signal converted by the RS-485 converter 340 may be transmitted to the antenna system through the RS-485 port 350

The AISG modem unit 360 serves to convert the OOK signal received through the OOK port 380 into a signal that may be processed by the main controller 330, for example, the Antenna Interface Standards Group (AISG) signal into the transistor to transistor logic (TTL) signal. Further, the AISG modem unit 330 converts the antenna system control signal (e.g., TTL signal) received from the main controller 330 into the OOK signal. The OOK port 380 is an input/output port of the OOK signal. Accordingly, the OOK signal converted by the AISG modem unit 360 may be transmitted to the antenna system through the OOK port 380.

At this point, the OOK port 380 receives a power signal (for example, a direct current (DC) power signal) from the power management unit 370 and transmits the DC power signal to the antenna system together with the OOK signal transmitted from the AISG modem unit 360.

As described above, the PAC 200 according to the embodiment of the present disclosure may provide the communication of the OOK signal as well as the communication of the RS-485 signal as shown in FIG. 3.

Figure 4:
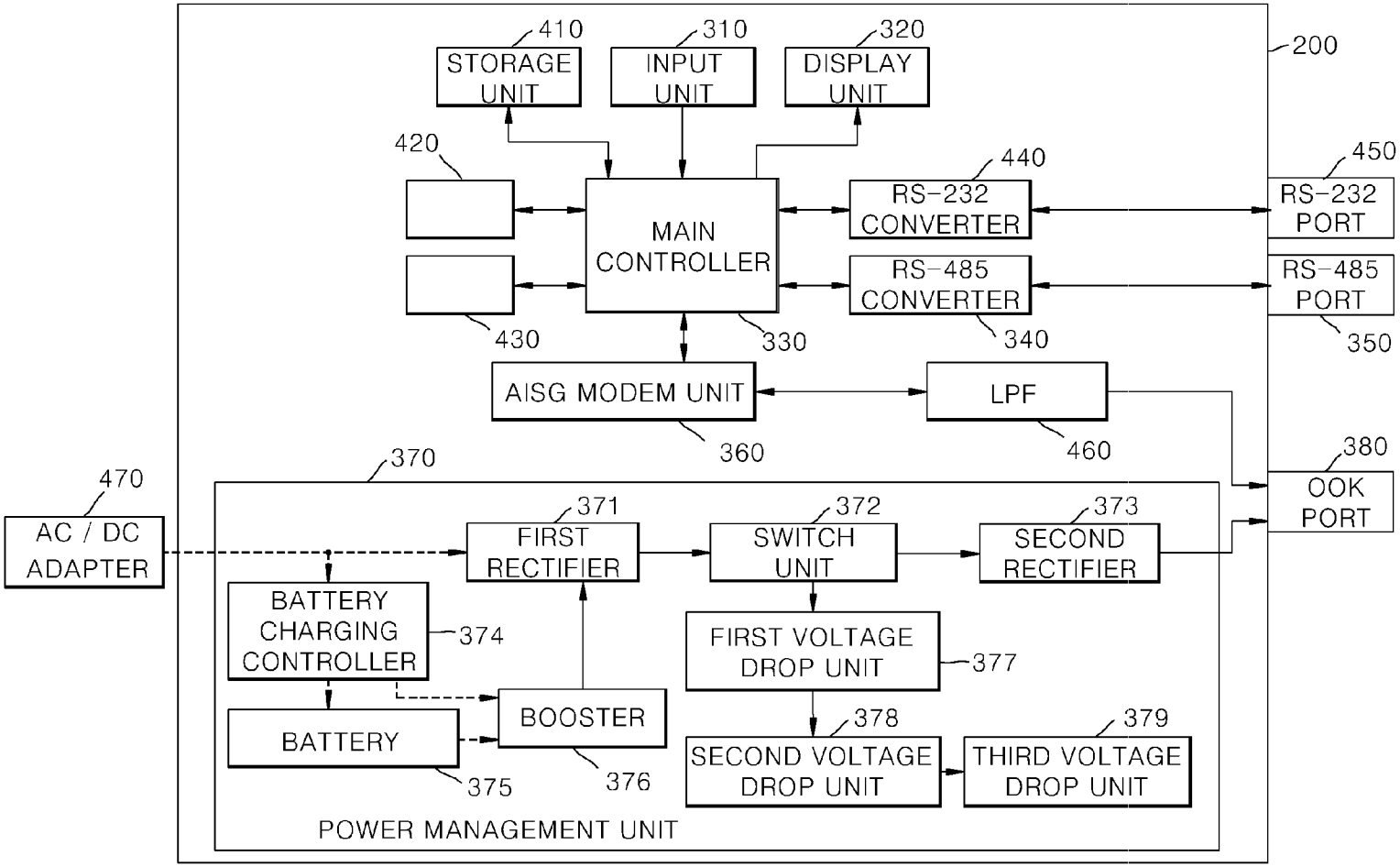
FIG. 4 is a block diagram illustrating the detailed configuration of the portable antenna control device according to the embodiment of the present disclosure.

FIG. 4 is a block diagram illustrating the detailed configuration of the portable antenna control device (PAC) according to the embodiment of the present disclosure. Referring to FIG. 4, the PAC 200 according to the embodiment of the present disclosure includes a storage unit 410, a watch Doc timer (WDT) 420, a real time clock (RTC) 420, an RS-232 converter 440, an RS-232 port 450, a low pass filter 460, and the like, in addition to the components of the PAC 200 of FIG. 3.

The storage unit 410 may store various information for controlling the antenna system according to the embodiment of the present disclosure. For example, an example of control history information may include information such as date, time, a BTS ID, a sector ID, an antenna model, an alarm history, and a tilt driving angle. Further, the storage unit 410 may be an electrically erasable programmable read-only memory (EEPROM), and the present disclosure is not limited thereto.

The WDT 420 serves to generate a reset signal when the main controller 330 has errors to initialize and restart the main controller 330. A real time clock (RTC) 430 serves to provide time information even when power is not supplied to the PAC 220.

The LPF 460 serves to filter and pass a band of the OOK signal transmitted and received. For example, the LPF 460 bypasses a signal in a 2.176 MHz band which is an on/off level of the OOK signal.

As illustrated, the power management unit 370 may be configured to include a first rectifier 371, a switch unit 372, a second rectifier 373, a battery charge controller 374, a battery pack 375, a step-up unit 376, a first voltage step-down unit 377, a second voltage drop part 378, and a third voltage step-down unit 379, and the like.

An AC/DC adapter 470 converts an AC input voltage into DC (for example, 24V) and supplies the DC to the PAC 200. The DC voltage supplied from the AC/DC adapter 470 may be supplied to the OOK port 380 through the first rectifier 371, the switch unit 372, and the second rectifier 373. At this point, the first rectifier 371 prevents a DC (24V) voltage supplied from the AC/DC adapter 470 and a voltage supplied from the battery 375 through the step-up unit 376 from colliding with each other and may be implemented using a diode, or the like. The switch unit 372 serves to switch a main power of the PAC 200. The second rectifier 373 blocks a reverse voltage (current) input from the OOK port 380.

The battery charge controller 374 serves to charge the battery 375 with the DC voltage supplied from the AC/DC adapter 470. The battery 375 charges the DC voltage supplied from the AC/DC adapter 470 under the control of the battery charge control unit 374 and supplies power to the PAC 200 when no power is supplied form the outside. On one hand, the PAC 200 may be carried by the charging function of the battery 375, and the PAC 200 may be used even in an area without a power outlet.

The step-up 376 receives the voltage charged in the battery 375 and serves to step up to a preset voltage (for example, 18 to 19 V).

The first voltage step-down unit 377 steps down the input voltage to 15V, the second voltage step-down unit 378 steps down the input voltage to 5V, the third voltage step-down unit 379 steps down the input voltage to 3.3V. The plurality of voltage step-down units 377 and 379 may also be implemented as one voltage step-down unit.

Meanwhile, when the PAC 200 is carried, the battery 375 is fully charged. In this state, when the AC/DC adapter 470 is removed, power may be supplied from the battery 375 as described above.

Meanwhile, in order to indicate that each component of the PAC 200 may be functionally and logically separated, each component is separately illustrated in the drawings and does not mean a physically necessarily separate component or is not implemented as a separate code.

Further, in the present specification, each functional unit may mean a functional and structural coupling of hardware for performing the technical spirit of the present disclosure and software for driving the hardware. For example, each functional unit may mean a predetermined code and a logical unit of a hardware resource to perform the predetermined code and does not necessarily mean a physically connected code or a kind of hardware, which may be easily inferred from a person having ordinary skill in the art to which the present disclosure pertains.

Figure 5:
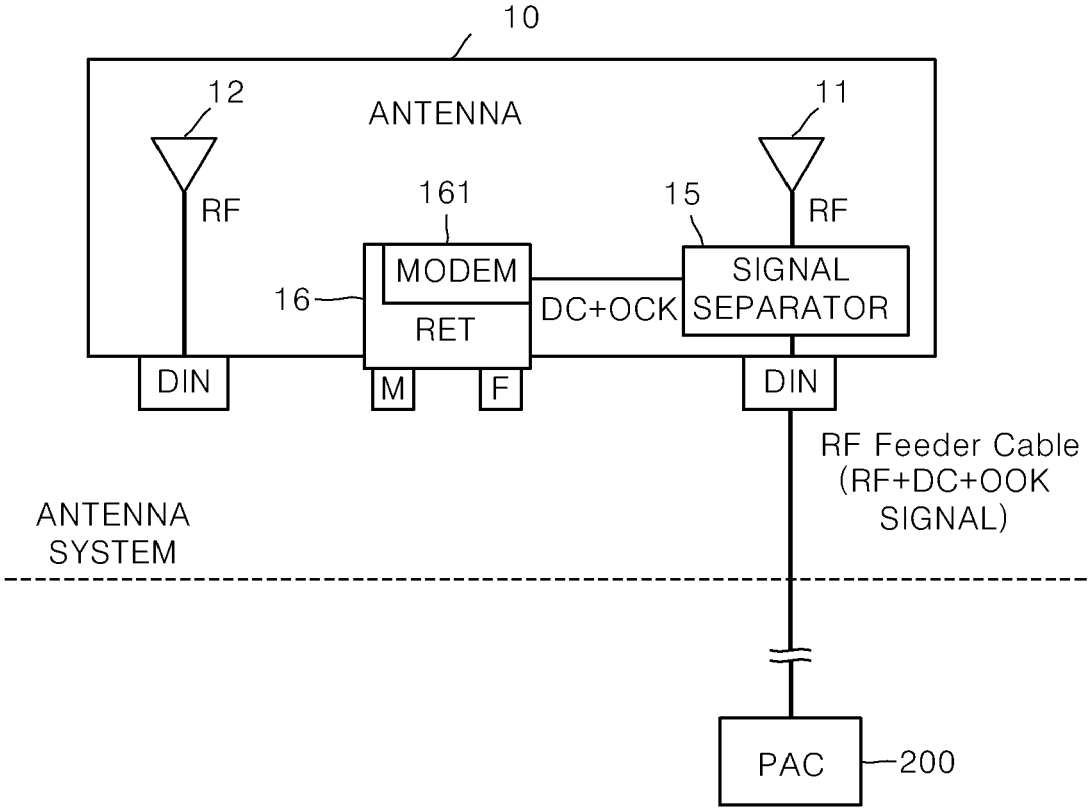
FIG. 5 is a block diagram of a system for an RET control of an antenna using a portable antenna control device in a mobile communication base station according to another embodiment of the present disclosure.

Hereinabove, an example of the detailed structure of the PAC 200 according to the embodiment of the present disclosure will be described with reference to FIGS. 3 and 4. Meanwhile, in FIG. 2, the PAC 200 according to the embodiment of the present disclosure is connected to the antenna system through the top ALD modem 13 that converts the OOK signal into the RS-485 signal, but as illustrated in FIG. 5, the PAC 200 may be directly connected to the antenna 10 via the RF feeder cable without the top ALD modem 130.

That is, the OOK signal, which is an antenna control signal output from the PAC 200, may be provided to the antenna system through the RF feeder cable. Unlike one illustrated in FIG. 2, according to the embodiment of the present disclosure, the PAC 200 may be configured to be directly connected to a connector (DIN connector) formed on a lower cap of a radome of the antenna 10 without passing through the bottom ALD modem (13 of FIG. 2).

At this point, the radome of the antenna 10 is provided with a signal separator 15, in which the signal separator 15 may have a bias-T structure simply constituted by a capacitor C and an inductor to separate the RF signal and the DC signal (and OOK signal combined with the DC signal) from each other and may be implemented in a form of a printed circuit board (PCB) on which related parts and circuit patterns are printed.

The signal separator 15 having the structure receives the RF+DC+OOK signals input to the DIN connector from the inside of the antenna 10 through the feeder cable to filter the DC signal+OOK signals and provide the filtered DC+OOK signals to RET equipment 16 and provides the RF signal to the first antenna unit 11 that is constituted by a plurality of radiating elements for transmission and reception. Meanwhile, the antenna 10 may include a plurality of antenna units each including a plurality of transmitting and receiving radiating devices, for example, a first antenna unit 11, a second antenna unit 12, or the like, and according to the present disclosure, the control signal for controlling the RET equipment 16 may be provided through a feeder cable of one of the antenna units, for example, the first antenna unit 11.

The RET equipment 16 may have a basic configuration for RET control, and may receive the DC+OOK signals provided from the signal separator 15 and use a DC signal as operation power. Further, the RET equipment 16 includes a modem 161 that converts the OOK signal into a predetermined format that may be internally recognized, for example, the RS-485 signal and the transistor-transistor logic (TTL) signal. Accordingly, the RET equipment 16 receives an RET control command through the modem 161 provided therein to perform the related RET control operation. In this case, the RET equipment 16 and the signal separator 15 may be connected to each other via the existing coaxial cable.

Describing the above configuration, the RET equipment 16 and the signal separator 15 may be mounted inside the radome forming the appearance of the antenna 10 and may be connected to each other via the coaxial cable. Therefore, compared with the FIG. 2, the top ALD modem for transmitting and receiving the OOK signal to and from the PAC 200 is unnecessary. As a result, it is possible to reduce the separate manufacturing cost required for the top ALD modem itself, the installation cost required for mounting the top ALD modem on the outside of the antenna 10, and the like.

Meanwhile, as equipment mounted on the antenna 10 to receive the control signal transmitted from the base station body system and perform an operation according to the corresponding control signal as described above, the RET equipment 16 has been described by way of example, but both the RAS equipment and the RAB equipment may also be operated similarly while being mounted in a similar manner. Further, the portable antenna control device may have the structure in which when all of the RET equipment, the RAS equipment, and the RAB equipment are mounted, they may be connected to one another in a daisy chain manner using the AISG cable.

Figure 6:
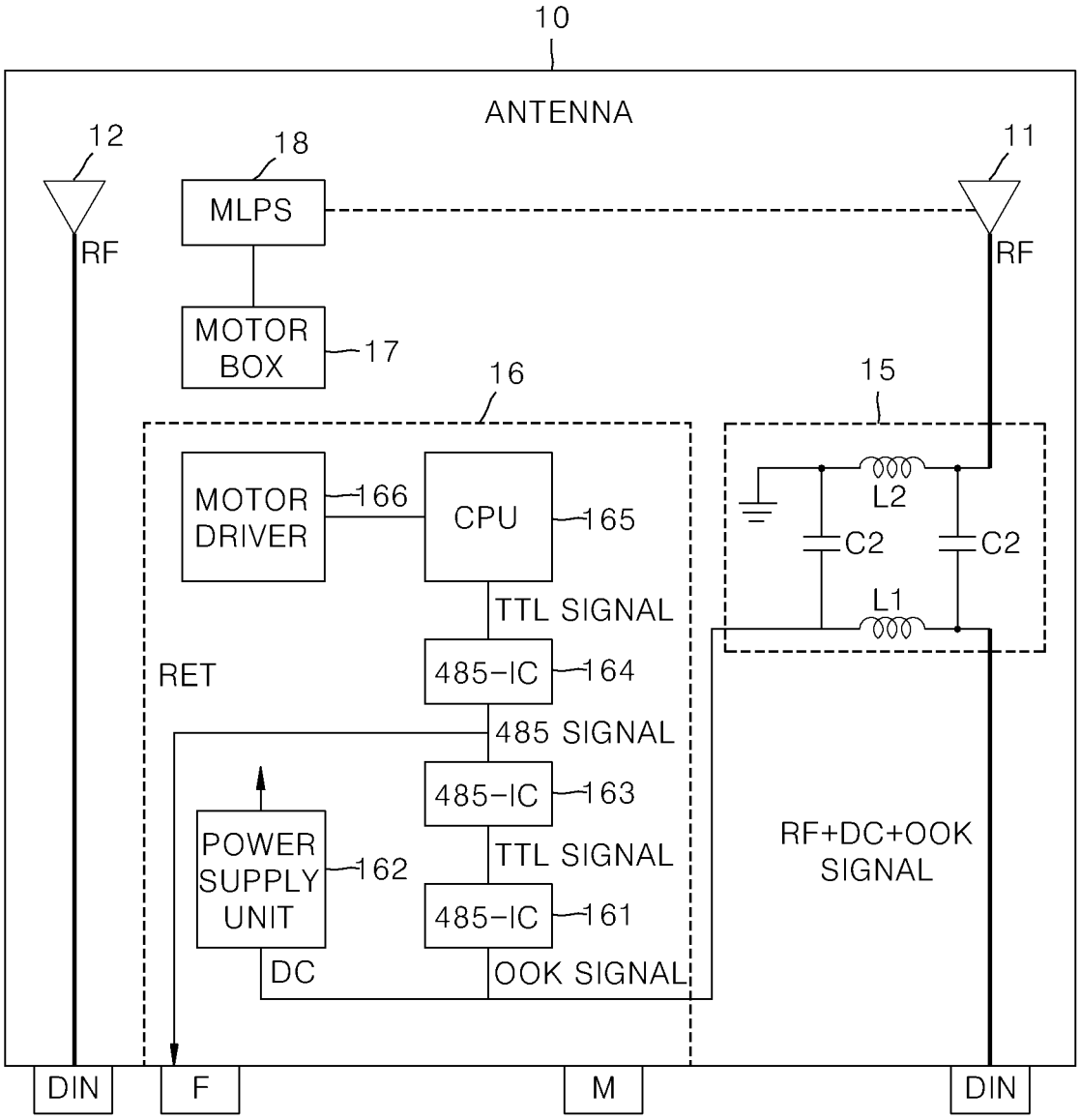
FIG. 6 is a detailed configuration diagram of main parts of an antenna according to the embodiment of the present disclosure.

FIG. 6 is a detailed block diagram of the main parts of the antenna illustrated in FIG. 5, and the detailed configurations of the signal separator 15 and the RET equipment 16, or the like are disclosed. Referring to FIG. 6, the signal separator 15 basically has the bias-T structure that is constituted by the capacitor C and the inductor L, in which only the RF signal is substantially separated by a first capacitor C1 to be provided to the first antenna unit 11 and the DC+OOK signals are substantially separated by a first inductor L1 to be provided to the RET equipment 16.

The RET equipment 16 includes a power supply unit 162 for receiving the DC+OOK signals provided from the signal separator 15 and providing the DC signal as operating power for the respective internal functional units and a modem 161 for converting the OOK signal into the TTL signal, as described above. For example, the power supply unit 162 may be supplied with a DC voltage of 10 to 30 V and includes three power ICs to perform a voltage conversion into +12V, +5V, and +3.3V, which may be supplied to the respective functional units requiring the corresponding voltage.

The TTL signal output from the modem 161 is provided to a first RS-485 circuit 163 and the first RS-285 circuit 163 converts the TTL signal into the RS-485 signal and provides the RS-285 signal to a second RS-485 circuit 164. The second RS-485 circuit 164 again converts the RS-285 signal into the TTL signal to be processed by a central processing unit (CPU) and provides the TTL signal to the CPU 165. Accordingly, the CPU 165 receives the control command to output an operation control signal to a motor driver 166 for driving a motor 17 and a multi line phase shifter 18 that are electrical and mechanical equipments for RET adjustment and the motor driver 166 drives the motor 17 accordingly.

In the above description, converting the TTL signal provided from the modem 161 into the RS-485 signal using the first RS-485 circuit 163 and the second RS-485 circuit 164 and then converting the RS-285 signal into the TTL signal again is for the RAS and RAB equipments that are other remote control target equipments connected to each other in a daisy chain form, another RET equipment, or the like, and the signal converted into the RS-285 signal by the first RS-485 circuit 163 is formed to be distributed into the AISG connector along with the second RS-485 circuit 164 and provided to the outside therethrough. Accordingly, when the RAS equipment, the RAB equipment, or the RET equipment is connected in the daisy chain form, as described above, the RAS equipment, the RAB equipment, or the RET equipment may receive the RS-485 signal output from the RET equipment 16 to the outside.

Meanwhile, the MLPS 18 adjusts phases of each of the radiating elements of the first antenna unit 11 (and/or the second antenna unit 12) so that the phases are generated by a predetermined difference, thereby adjusting the overall down tilt angle of the antenna. The MLPS 18 is actually provided as a signal path provided to each radiating element of the first antenna unit 11 (and/or the second antenna unit 12) in the signal separator 15, but the position of the MLPS 18 is schematically illustrated for convenience of explanation.

The configuration and operation of the antenna system of the mobile communication base station according to the embodiment of the present disclosure may be performed as described above. Meanwhile, the detailed embodiments are described in the description of the present disclosure but various changes may be practiced without departing from the scope of the present disclosure.

For example, in the above description, as equipment mounted on the antenna 10 to receive the control signal transmitted from the base station body system and perform an operation according to the corresponding control signal as described above, the RET equipment 16 has been described by way of example, but both the RAS equipment and the RAB equipment may also be operated similarly while being mounted in a similar manner. In addition, a variety of other equipment may be installed in a similar manner.

Hereinabove, various embodiments of the detailed structure of the PAC 200 according to the embodiment of the present disclosure and the antenna system connected thereto have been described.

Hereinafter, examples of an antenna control system in which the PAC 200 according to the embodiment of the present disclosure may be connected to the antenna system configured in various forms will be described.

FIGS. 7 to 15 are views illustrating a connection relationship between an antenna system and a portable antenna control device according to various embodiments of the present disclosure.

Figure 7:
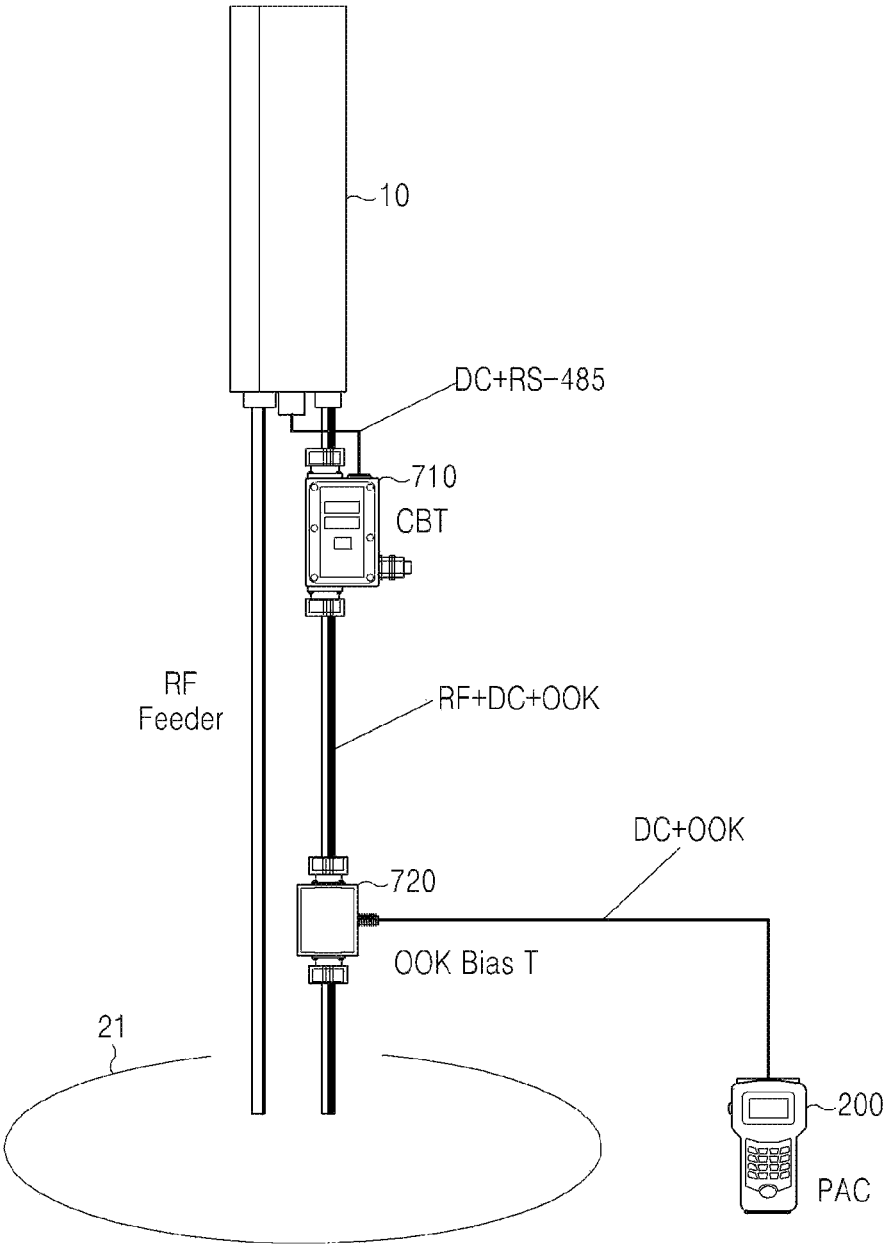
FIGS. 7 to 15 are views illustrating a connection relationship between an antenna system and a portable antenna control device according to various embodiments of the present disclosure.

Referring to FIG. 7, the antenna 10 is connected to a base station body unit 21 via the RF feeder cable. At this point, one terminal of the antenna 10 may be directly connected to the base station body unit 21 via the RF feeder cable and the other terminal thereof may be connected to the base station body unit 21 via the CBT 710 and the OOK bias T 720.

As described above, the CBT 710 serves to convert the RS-485 signal into the OOK signal or the OOK signal into the RS-485 signal, and the OOK Bias T 720 serves to combine the RF signal with the AISG signal or separate the RF signal from the AISG signal.

Accordingly, if the PAC 200 according to the embodiment of the present disclosure is connected to an OOK bias T 720 through the OOK port 380, the OOK bias T 720 integrates the RF signal provided from the base station body unit 21 with the DC+OOK signals output from the OOK port 380 of the PAC 200 and transmits the integrated signal to the CBT 710. The CBT 710 receives the RF+DC+OOK signals from the OOK bias T 720 and converts the DC+OOK signals into the DC+RS-485 signals and provides the DC+RS-485 signals to the RET 14. By doing so, the PAC 200 may control the RET 14 of the antenna 10 using the OOK signal.

Figure 8:
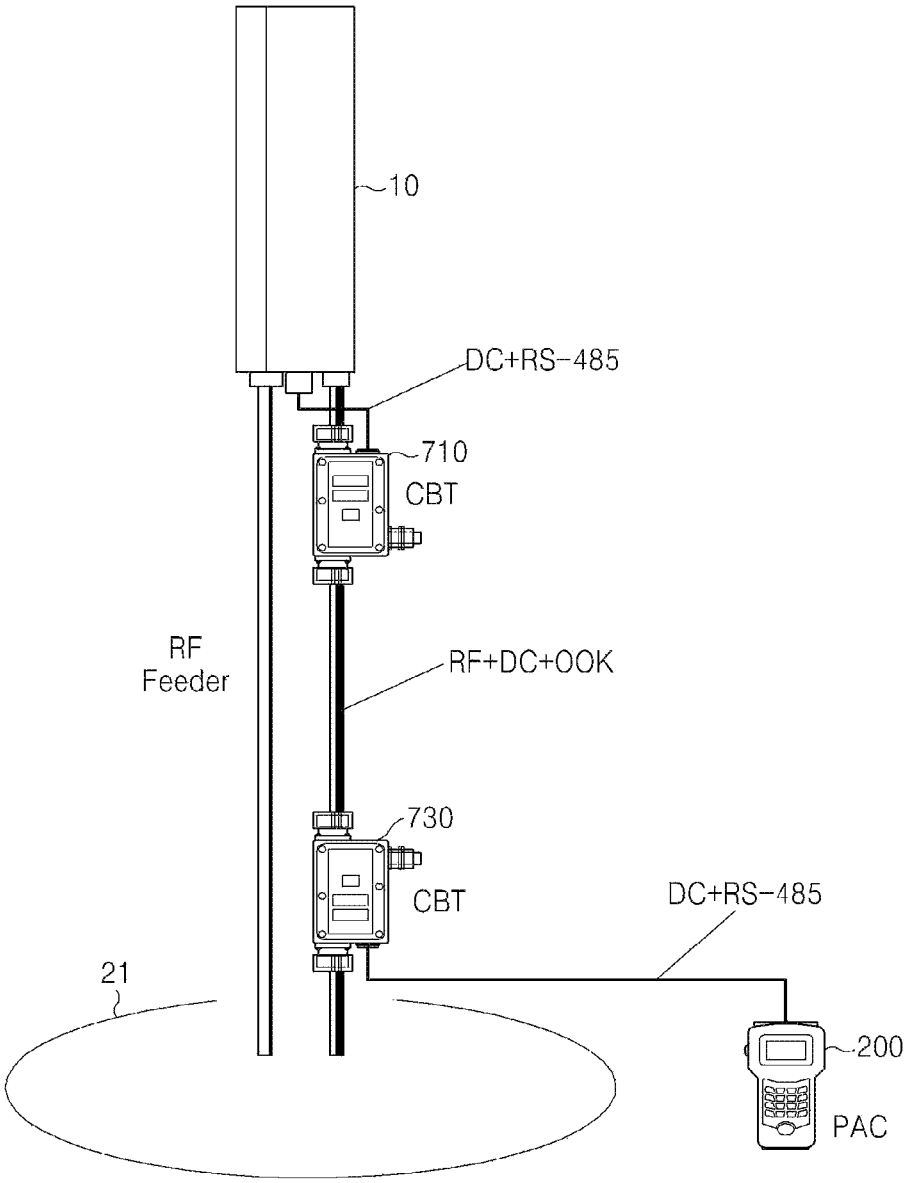

Referring to FIG. 8, the antenna 10 is connected to a base station body unit 21 via the RF feeder cable. At this point, one terminal of the antenna 10 may be directly connected to the base station body unit 21 via the RF feeder cable and the other terminal thereof may be connected to the base station body unit 21 through the two CBTs 710 and 730 (hereinafter, first CBT 710 and second CBT 730).

As described above, the CBTs 710 and 730 serve to convert the RS-485 signal into the OOK signal or the OOK signal into the RS-485 signal.

Accordingly, if the PAC 200 according to the embodiment of the present disclosure is connected to the second CBT 730 through the OOK port 350, the second CBT 730 converts and integrates the RF signal provided from the base station body unit 21 and the DC+RS-485 signals output from the RS-485 port 350 of the PAC 200 and transmits the integrated signal to the CBT 710. That is, the second CBT 730 converts the DC+RS-485 signals output from the RS-485 port 350 of the PAC 200 into the DC+OOK signals and integrates the converted DC+OOK signals with the RF signal and transmits the integrated signal to the first CBT 710.

The CBT 710 receives the RF+DC+OOK signals from the second CBT 730 and converts the DC+OOK signals into the DC+RS-485 signals and provides the DC+RS-485 signals to the RET 14. By doing so, the PAC 200 may control the RET 14 of the antenna 10 using the RS-485 signal.

Figure 9:
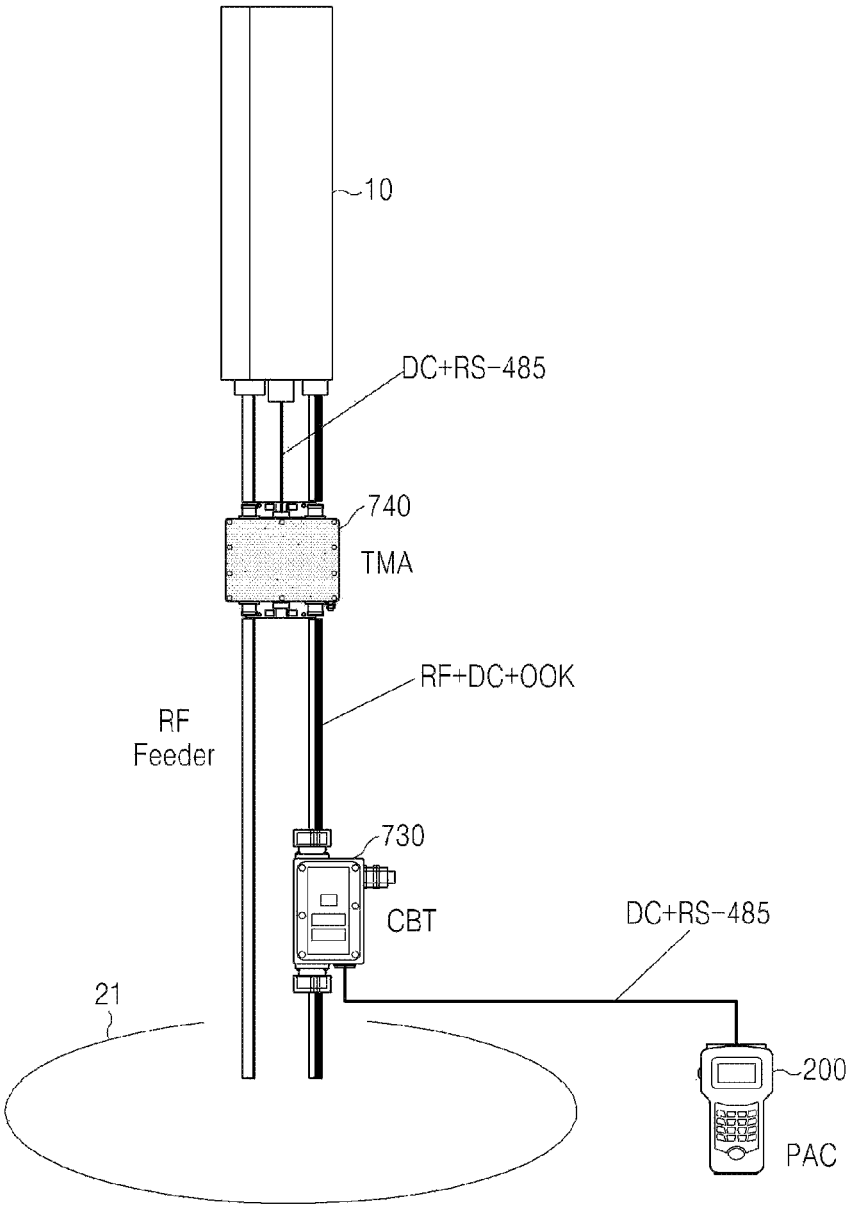

Referring to FIG. 9, the antenna 10 may be connected to the base station body unit 21 via the RF feeder cable, and a TMA 740 may be provided between the antenna 10 and the base station body unit 21. As described above, the tower mounted amplifier (TMA) is a device including the low noise amplifier (LNA) and may control and electrically monitor it and may further include the modem function. At this point, one terminal of the TMA 740 connected to the base station body unit 21 in the TMA 740 may be connected to the CBT 730 as illustrated in FIG. 9. As described above, the CBT 730 serve to convert the RS-485 signal into the OOK signal or the OOK signal into the RS-485 signal.

Accordingly, if the PAC 200 according to the embodiment of the present disclosure is connected to the CBT 730 through the OOK port 350, the CBT 730 converts and integrates the RF signal provided from the base station body unit 21 and the DC+RS-485 signals output from the RS-485 port 350 of the PAC 200 and transmits the integrated signal to the CBT 740. That is, the CBT 730 converts the DC+RS-485 signals output from the RS-485 port 350 of the PAC 200 into the DC+OOK signals and integrates the converted DC+OOK signals with the RF signal and transmits the integrated signal to the TMA 740.

The TMA 740 receives the RF+DC+OOK signals from the CBT 730 and converts the DC+OOK signals into the DC+RS-485 signals and provides the DC+RS-485 signals to the RET 14. By doing so, the PAC 200 may control the RET 14 of the antenna 10 using the RS-485 signal.

Figure 10:
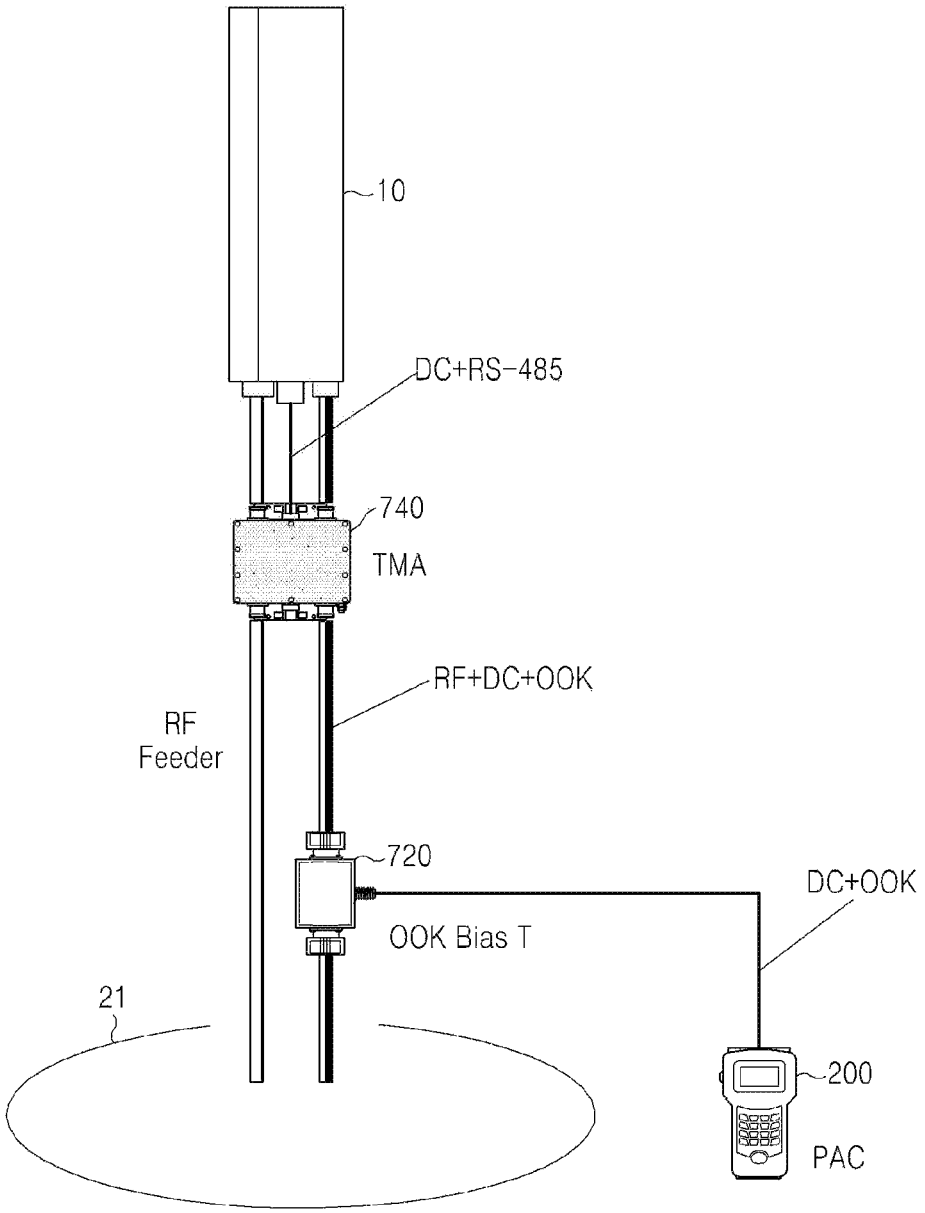

Referring to FIG. 10, the antenna 10 may be connected to the base station body unit 21 via the RF feeder cable, and a TMA 740 may be provided between the antenna 10 and the base station body unit 21. As described above, the tower mounted amplifier (TMA) is a device including the low noise amplifier (LNA) and may control and electrically monitor it and may further include the modem function. At this point, as illustrated in FIG. 10, one terminal of the TMA 740 connected to the base station body unit 21 may be connected to the OOK bias T 720. As described above, the OOK bias T 720 serves to combine the RF signal with the AISG signal or separate the RF signal from the AISG signal.

Accordingly, if the PAC 200 according to the embodiment of the present disclosure is connected to an OOK bias T 720 through the OOK port 380, the OOK bias T 720 integrates the RF signal provided from the base station body unit 21 with the DC+OOK signals output from the OOK port 380 of the PAC 200 and transmits the integrated signal to the TMA 740. The TMA 740 receives the RF+DC+OOK signals from the OOK bias T 720 and converts the DC+OOK signals into the DC+RS-485 signals and provides the DC+RS-485 signals to the RET 14. By doing so, the PAC 200 may control the RET 14 of the antenna 10 using the OOK signal.

Figure 11:
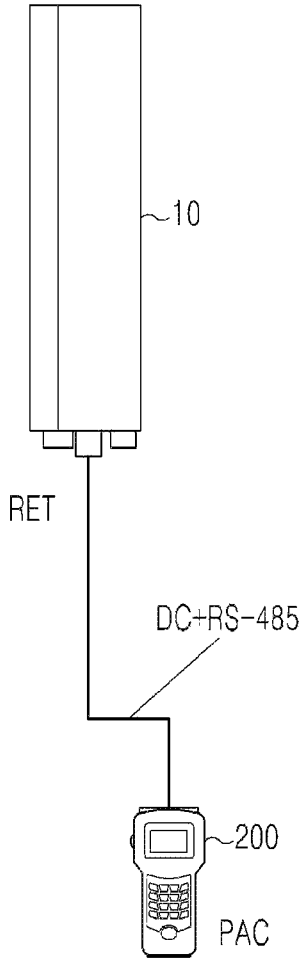
Figure 12:
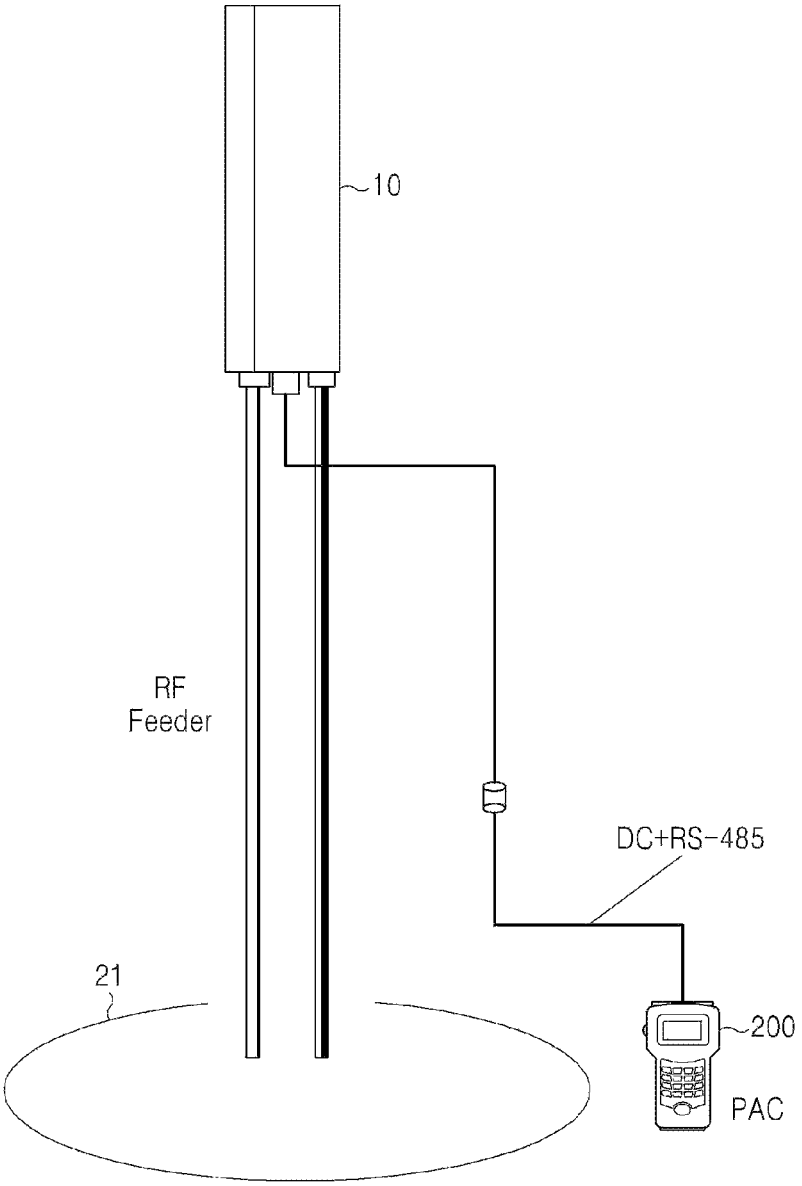

Referring to FIG. 11, the PAC 200 may be directly connected to the RET 14 of the antenna 10 through the RS-485 port 350. Therefore, the DC+RS-485 signals output from the RS-485 port 350 of the PAC 200 may be directly provided to the RET 14. By doing so, the PAC 200 may control the RET 14 of the antenna 10 using the RS-485 signal. Further, referring to FIG. 12, the cable connected to the RS-485 port 350 of the PAC 200 and the cable connected to the RET 14 of the antenna 10 are connected to each other, thus the RS-485 port 350 and the RET 14 of the antenna 10 may be connected to each other. Therefore, it is possible for an operator to connect the cable without going up to a tower where the antenna 10 is installed.

Figure 13:
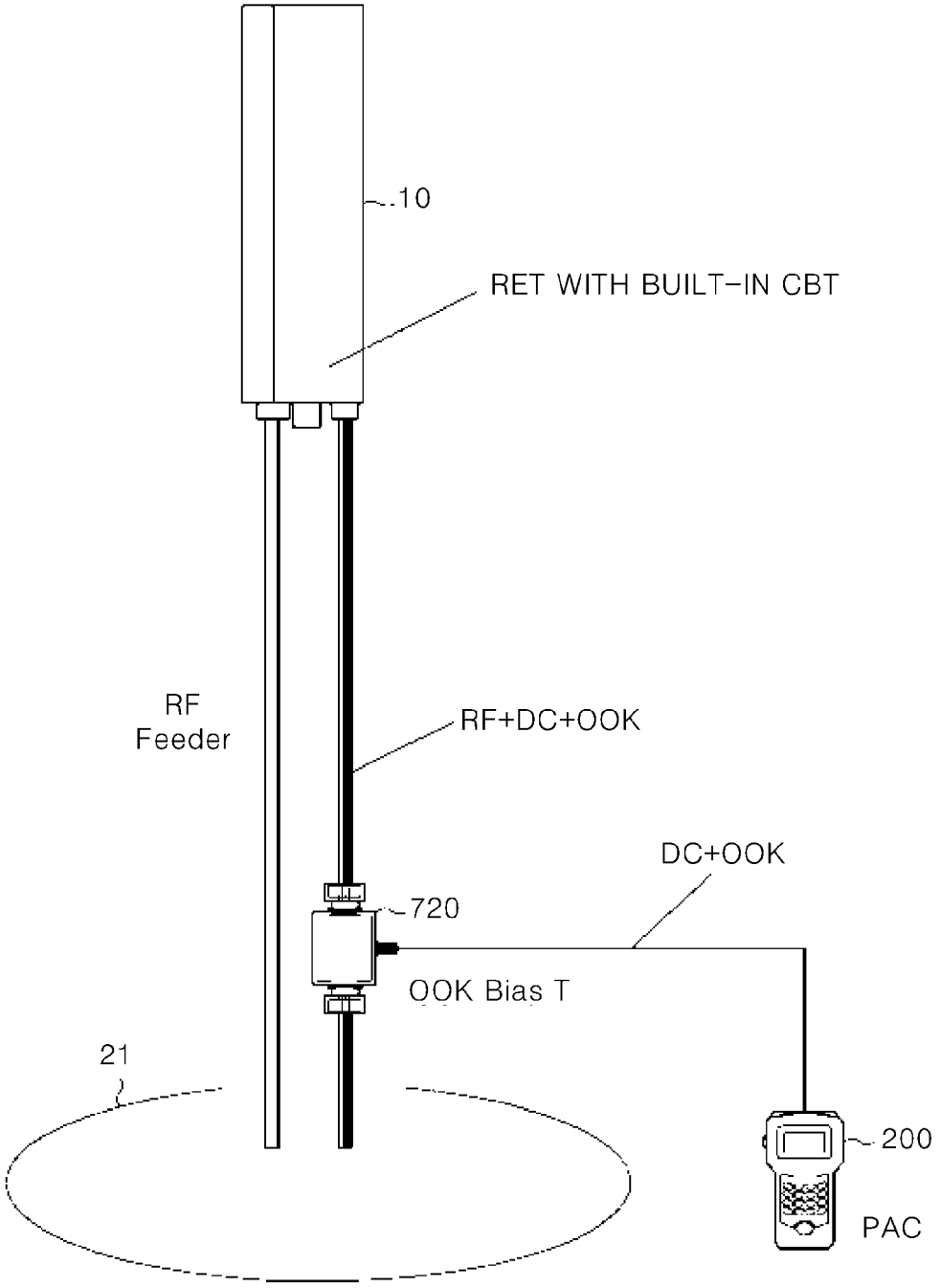
Figure 14:
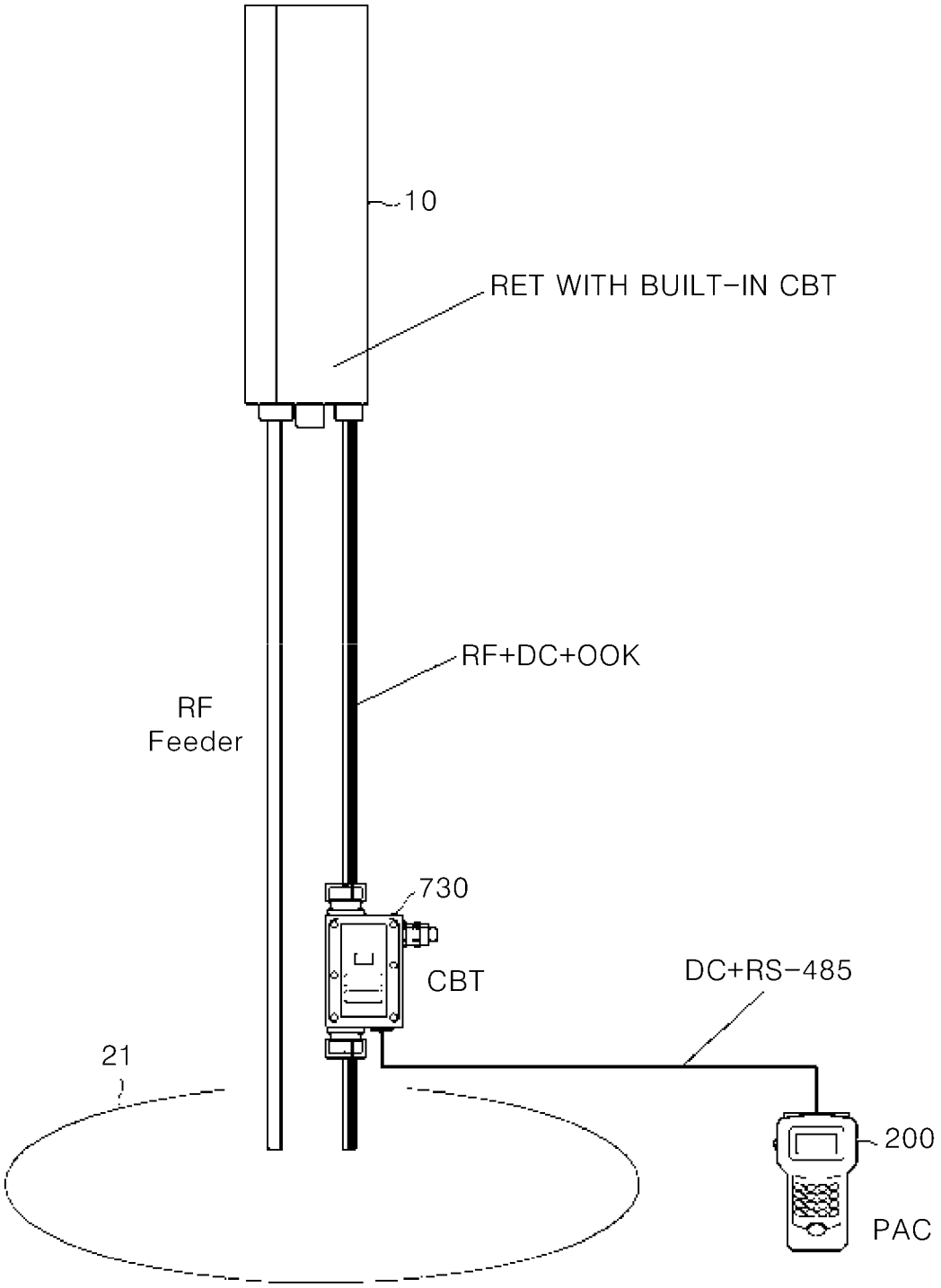
Figure 15:
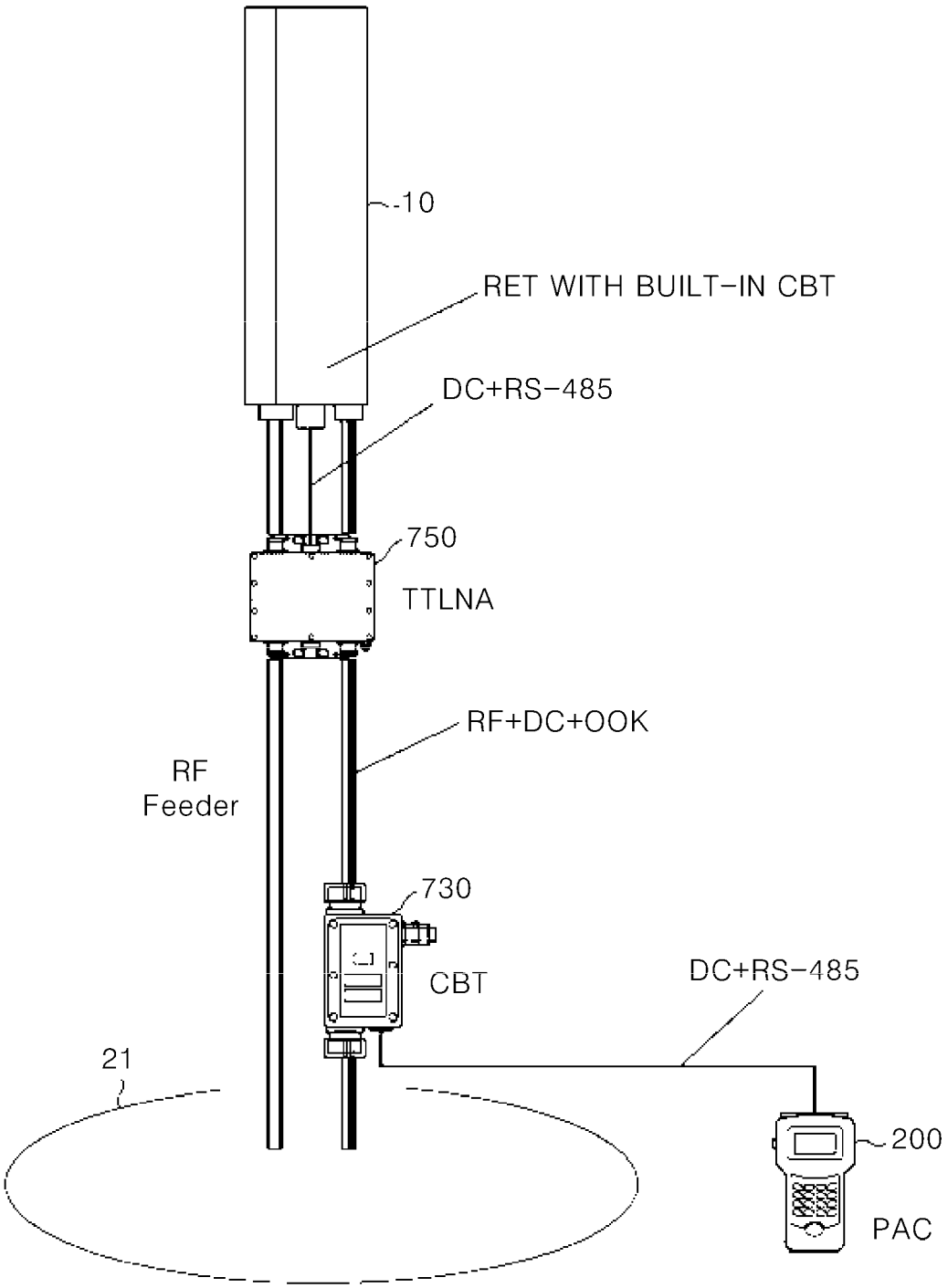

FIGS. 13 to 15 are views illustrating various examples of connecting the PAC 200 according to the embodiment of the present disclosure to the antenna 10, in the form in which the CBT is built in the antenna 10 as illustrated in FIGS. 5 and 6.

Referring to FIG. 13, the antenna 10 is connected to the base station body unit 21 via the RF feeder cable. At this point, one terminal of the antenna 10 may be directly connected to the base station body unit 21 via the RF feeder cable and the other terminal thereof may be connected to the base station body unit 21 through the OOK bias T 720.

As described above, the OOK bias T 720 serves to combine the RF signal with the AISG signal or separate the RF signal from the AISG signal.

Accordingly, if the PAC 200 according to the embodiment of the present disclosure is connected to an OOK bias T 720 through the OOK port 380, the OOK bias T 720 integrates the RF signal provided from the base station body unit 21 with the DC+OOK signals output from the OOK port 380 of the PAC 200 and transmits the integrated signal to the antenna 10. The antenna 10 receives the RF+DC+OOK signals from the OOK bias T 720 and as illustrated in FIG. 5, separates the DC+OOK signals from the RF+DC+OOK signals by the signal separator 15 in the antenna 10. The separated DC+OOK signal may control the RET 14 by converting the OOK signal into the TTL signal or the RS-485 signal by the modem 161 included in the RET 16.

Referring to FIG. 14, the antenna 10 is connected to the base station body unit 21 via the RF feeder cable. At this point, one terminal of the antenna 10 may be directly connected to the base station body unit 21 via the RF feeder cable and the other terminal thereof may be connected to the base station body unit 21 via the CBT 730.

As described above, the CBT 730 serve to convert the RS-485 signal into the OOK signal or the OOK signal into the RS-485 signal.

Accordingly, if the PAC 200 according to the embodiment of the present disclosure is connected to the CBT 730 through the OOK port 350, the CBT 730 converts and integrates the RF signal provided from the base station body unit 21 and the DC+RS-485 signals output from the RS-485 port 350 of the PAC 200 and transmits the integrated signal to the antenna 10. That is, the CBT 730 converts the DC+RS-485 signals output from the RS-485 port 350 of the PAC 200 into the DC+OOK signals and integrates the converted DC+OOK signals with the RF signal and transmits the integrated signal to the antenna 10.

The antenna 10 receives the RF+DC+OOK signals from the CBT 730 and as illustrated in FIG. 5, separates the DC+OOK signals from the RF+DC+OOK signals by the signal separator 15 in the antenna 10. The separated DC+OOK signal may control the RET 14 by converting the OOK signal into the TTL signal or the RS-485 signal by the modem 161 included in the RET 16.

Referring to FIG. 15, the antenna 10 may be connected to the base station body unit 21 via the RF feeder cable, and a TMA 750 may be provided between the antenna 10 and the base station body unit 21. As described above, the tower mounted amplifier (TMA) is a device including the low noise amplifier (LNA) and may control and electrically monitor it and may further include the modem function. At this point, one terminal of the TMA 750 connected to the base station body unit 21 in the TMA 740 may be connected to the CBT 730 as illustrated in FIG. 9. As described above, the CBT 730 serve to convert the RS-485 signal into the OOK signal or the OOK signal into the RS-485 signal.

Accordingly, if the PAC 200 according to the embodiment of the present disclosure is connected to the CBT 730 through the OOK port 350, the CBT 730 converts and integrates the RF signal provided from the base station body unit 21 and the DC+RS-485 signals output from the RS-485 port 350 of the PAC 200 and transmits the integrated signal to the CBT 750. That is, the CBT 730 converts the DC+RS-485 signals output from the RS-485 port 350 of the PAC 200 into the DC+OOK signals and integrates the converted DC+OOK signals with the RF signal and transmits the integrated signal to the TMA 750.

The TMA 750 receives the RF+DC+OOK signals from the CBT 730 and converts the DC+OOK signals into the DC+RS-485 signals and provides the DC+RS-485 signals to the antenna 10, thereby controlling the RET 14.

Figure 16:
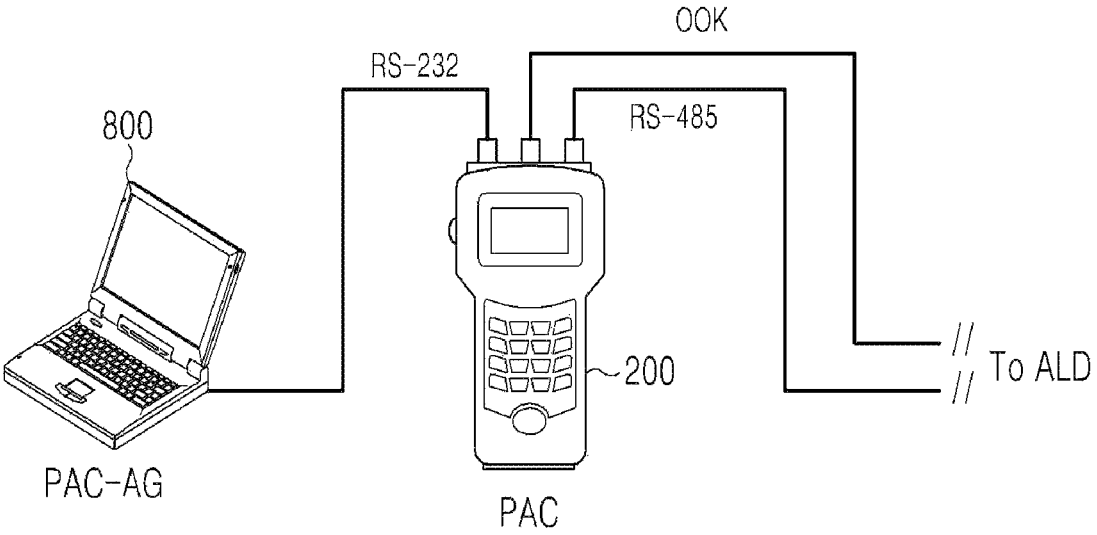
FIG. 16 is a diagram illustrating a connection relationship between the portable antenna control device according to an embodiment of the present disclosure and a PC.

FIG. 16 is a diagram illustrating a connection relationship between the portable antenna control device according to an embodiment of the present disclosure and a PC. Referring to FIG. 16, the PAC 200 may be connected to the ALD via the RS-485 port or the OOK port that is provided according to the embodiment of the present disclosure. In addition, according to another embodiment of the present disclosure, the PAC 200 may be connected to a user terminal such as a PC 800 via an RS-232 port 450 as illustrated in FIG. 4. At this point, the PC 800 may be given a portable antenna control device AISG GUI (PAC-AG) function. By doing so, it is possible to easily install and update software by the PC 800.

Figure 17:
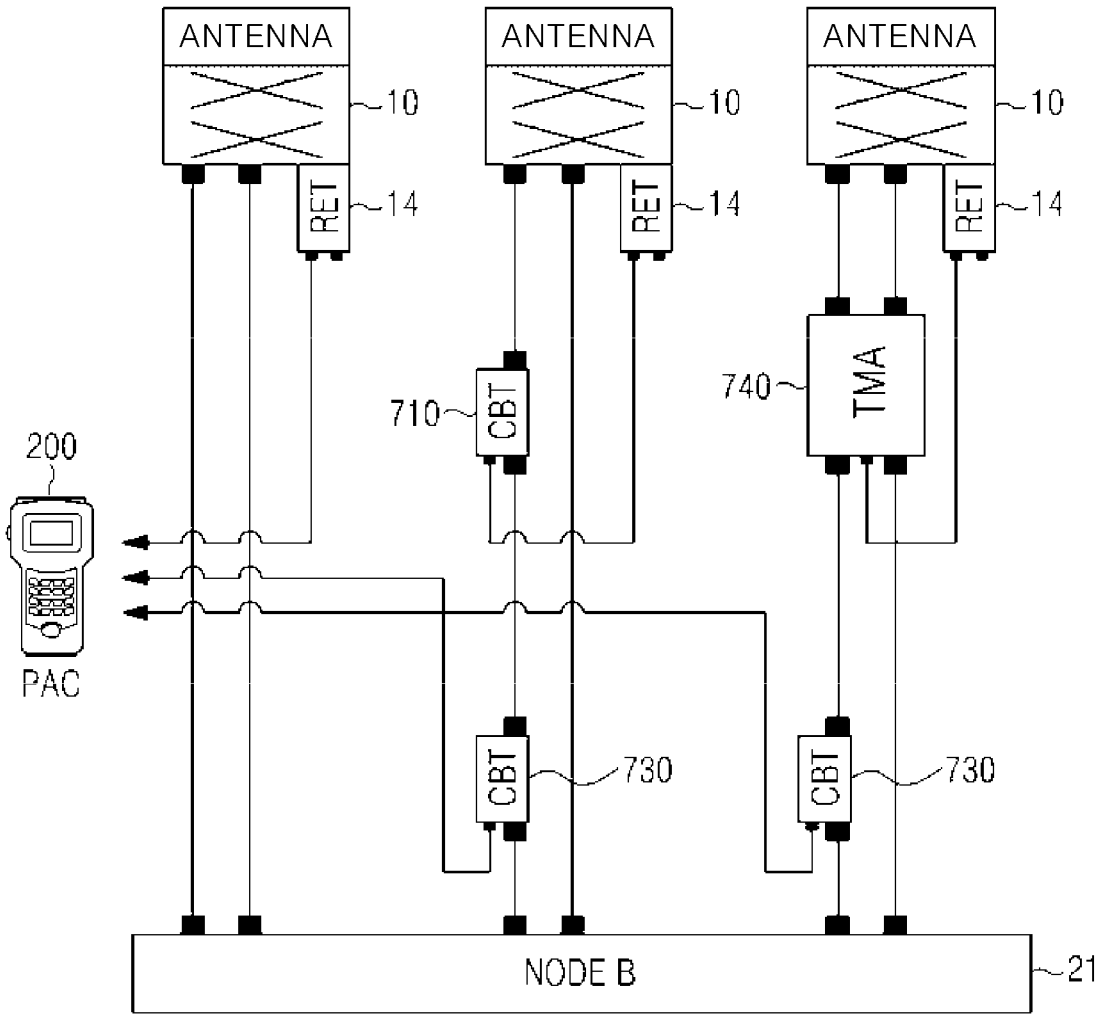
FIG. 17 is a diagram illustrating a connection relationship between the portable antenna control device and the antenna system according to an embodiment of the present disclosure.

In addition, when interlocking with the PC, it is possible to implement the software debugging using the RS-232 port and to store and retrieve a history about ALD scanning and control information FIG. 17 is a diagram illustrating a connection relationship between the portable antenna control device and the antenna system according to an embodiment of the present disclosure. Referring to FIG. 17, the PAC 200 may be connected to each antenna 10 by various methods as described above.

Figure 18:
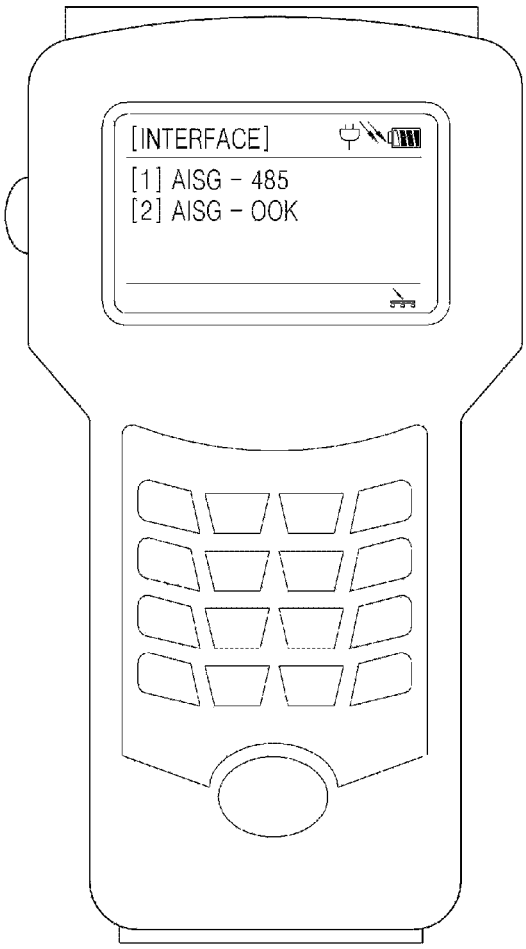
FIG. 18 is a diagram illustrating a port selection screen of the portable antenna control device according to the embodiment of the present disclosure.

For example, as illustrated in FIG. 17, the PAC 200 may be directly connected to the RET 14 of the antenna 10 or may be connected thereto via the first CBT 710 and the second CBT 730 connected to the antenna 10. Further, the PAC 200 may be connected to the RET 14 even via the TMA 740 and the CBT 730 which are connected to the antenna 10. FIG. 18 is a diagram illustrating a port selection screen of the portable antenna control device according to the embodiment of the present disclosure. Referring to FIG. 18, when the PAC 200 is connected to the antenna 10 and then executed, according to an embodiment of the present disclosure, a screen for selecting whether the control signal is transmitted through the RS-485 port or the control signal may be displayed. At this point, according to the embodiment of the present disclosure, the user may select the RS-485 port or the OOK port to implement various connection methods with the antenna 10.

As described above, the present disclosure has been made with reference to specific matters such as the detailed components and the limited exemplary embodiments, but is provided to help a general understanding of the present disclosure. Therefore, the present disclosure is not limited to the above exemplary embodiments and can be variously changed and modified from the description by a person skilled in the art to which the present disclosure pertain.

Therefore, the spirit of the present disclosure should not be limited to these exemplary embodiments, but the claims and all of modifications equal or equivalent to the claims are intended to fall within the scope and spirit of the disclosure.

What is claimed is:

1. A portable antenna control device, comprising:

a main controller configured to generate a control signal for adjusting a device in an antenna;

a modem configured to convert the control signal generated by the main controller directly into an on-off keying (OOK) signal and to directly transmit the OOK signal to a communication port which is provided in the portable antenna control device;

the communication port configured to receive the OOK signal from the modem, and to transmit the OOK signal externally to an antenna system through a radio frequency (RF) feeder cable; and a battery configured to supply power to the main controller and the modem; and a case which physically encloses the main controller, the modem, the communication port, and the battery, wherein the communication port is further configured to provide direct current (DC) power to the antenna system through the RF feeder cable.

2. The portable antenna control device of claim 1, further comprising:

a power management unit configured to manage the battery to supply the power to the main controller and the modem.

3. The portable antenna control device of claim 1, wherein the control signal generated by the main controller is a transistor-transistor logic (TTL) signal.

4. The portable antenna control device of claim 1, wherein the device provided in the antenna is at least one of a remote electrical tilt (RET) equipment for adjusting an electronic down tilt angle, a remote azimuth steering (RAS) equipment for adjusting azimuth steering, and a remote azimuth beamwidth (RAB) equipment for adjusting an azimuth beamwidth.

5. The portable antenna control device of claim 1, further comprising:

an RS-485 converter for converting another control signal generated by the main controller into an RS-485 signal; and an RS-485 port for outputting the RS-485 signal converted by the RS-485 converter.

6. The portable antenna control device of claim 1, further comprising:

an RS-232 converter for converting another control signal generated by the main controller into an RS-232 signal; and an RS-232 port for outputting the RS-232 signal converted by the RS-232 converter.

7. The portable antenna control device of claim 1, wherein the device provided in the antenna is at least one of a remote electrical tilt (RET) equipment for adjusting an electronic down tilt angle, a remote azimuth steering (RAS) equipment for adjusting azimuth steering, and a remote azimuth beamwidth (RAB) equipment for adjusting an azimuth beamwidth.

8. The portable antenna control device of claim 1, further comprising:

a low pass filter (LPF) provided between the modem and the communication port and filtering and passing a band of the OOK signal converted by the modem.

9. The portable antenna control device of claim 1, further comprising:

a battery charge controller for charging the battery with a DC voltage supplied from an external AC/DC adapter.

10. The portable antenna control device of claim 1, wherein the modem does not generate an RS-485 signal in a process of converting the control signal into the on-off keying (OOK) signal.

11. The portable antenna control device of claim 1, wherein the modem is configured to convert the control signal in a transistor-transistor logic (TTL) format to an Antenna Interface Standards Group (AISG) format.

* * * * *